US011413619B1

(12) United States Patent
Qin et al.

(10) Patent No.: US 11,413,619 B1
(45) Date of Patent: Aug. 16, 2022

(54) DOUBLE-LAYER MULTI-WELL PLATE

(71) Applicant: Lidong Qin, Houston, TX (US)

(72) Inventors: Lidong Qin, Houston, TX (US); Kai Zhang, Manvel, TX (US); Joon Hee Jang, Katy, TX (US); Myeong Chan Jo, Houston, TX (US)

( * ) Notice: Subject to any disclaimer, the term of this patent is extended or adjusted under 35 U.S.C. 154(b) by 208 days.

(21) Appl. No.: 16/932,225

(22) Filed: Jul. 17, 2020

(51) Int. Cl.
*B01L 3/00* (2006.01)

(52) U.S. Cl.
CPC ..... *B01L 3/5085* (2013.01); *B01L 2200/0642* (2013.01); *B01L 2200/0684* (2013.01); *B01L 2200/142* (2013.01)

(58) Field of Classification Search
CPC ..... B01L 3/5085; B01L 2200/0642; B01L 2200/0684; B01L 2200/142
USPC ..... 422/552, 553, 551
See application file for complete search history.

*Primary Examiner* — Natalia Levkovich
(74) *Attorney, Agent, or Firm* — Michael D. Eisenberg

(57) ABSTRACT

A multi-well plate comprising: inlet wells configured to contain liquid; walled observation windows located between the inlet wells, each observation window being associated with a respective inlet well; detection wells, each being disposed below a respective observation window and being associated with the respective inlet well associated with the respective observation window; outlet wells located between the inlet wells and the observation windows, each outlet well being associated with a respective inlet well and a respective detection well; inlet channels, disposed in first groups, each first group providing fluid communication between an inlet well and a respective detection well; outlet channels, disposed in second groups, each second group providing fluid communication between a detection well and a respective outlet well. The inlet channels are configured to prevent passage of the liquid from the inlet wells to the respective detection wells if no external force is applied to the liquid.

15 Claims, 20 Drawing Sheets

DOUBLE-LAYER MULTI-WELL PLATE

TECHNICAL FIELD

The present invention, in some embodiments thereof, relates to a double-layer multi-well plate for efficient and safe handling of small-volume liquids and their inclusions to implement molecular-based and cell-based assays.

BACKGROUND OF THE INVENTION

Using a small volume of a liquid to implement analysis of the liquid has become more and more attractive, because reducing the consumption of sample and reagent can reduce testing costs and the pressure of sample collection especially those from rare clinical samples.

The multi-well plate, also known as multiwell plate or microwell plate or microtiter plate, is a rectangular device that contains a plurality of single-layer open wells configured to contain liquid samples to be analyzed in an array format, such as 6-, 12-, 24-, 48-, 96-, 384-, and 1,536-well plate. Among them, the 96-well plate is the most commonly used due to the moderate well size and number of wells. With the assistance of pipetting system and imaging system, various liquid handling procedures can be implemented in the wells of the single-layer multi-well plate, such as mixing, storage, incubation, culture, separation, and detection. The single-layer multi-well plate has become a widely used tool in analytical research and clinical diagnostic testing laboratories.

BRIEF SUMMARY OF EMBODIMENTS OF THE INVENTION

The inventors have found that the single-layer multi-well plate still encounters several serious challenges in the safe handling of small volumes of liquid.

In the processing of small volumes of liquid, two critical interference factors prevent proper handling of the liquid in the wells of the single-layer multi-well plate: liquid evaporation and air bubble formation. However, both of them are difficult to be overcome in the current single-layer multi-well plate.

The liquid's evaporation should be carefully considered when handling a small volume of a liquid because even a small loss of the liquid from evaporation may significantly reduce the total liquid volume. In the wells of single-layer multi-well plate, liquids have a large area directly exposed to air and therefore uncontrollable evaporation problems are likely occur, especially when a chemical or biological reaction occurs in the wells, that requires a long incubation period in the wells before the analysis of the liquid can be performed. Moreover, evaporation is a serious problem if the liquid is part of a culture, as evaporation of the liquid changes the concentration of the culture's medium. Using a sealing tape to cover the wells can help reduce liquid loss of evaporation. However, sealing tape is usually opaque or semitransparent and cannot be used if the reaction in the well needs to be optically monitored in real time.

Air bubbles are very easily generated within wells of single-layer multi-well plate in the handling of small volumes liquid—for example as liquid is introduced into the wells, mixed inside the wells, or reacting inside the wells. In many cases, these air bubbles are difficult to remove due to low liquid surface tension. The co-existence of air bubbles and liquids in the wells in which the liquid is detected and analyzed significantly affects the transmission of light through the liquid layer. As a result, both accuracy and repeatability of the liquid's optical analysis are decreased by using single-layer multi-well plate to implement small-volume liquid-based assays. Moreover, the presence of bubbles in the liquid can accelerate the liquid's oxidation, thereby changing the chemical composition of the liquid. This is critical for liquid storage.

In this invention, a novel structure for a multi-well plate is provided: the double-layer multi-well plate which contains two layers of wells. The upper layer includes inlet wells, observation windows, and outlet wells, while the lower level includes detection wells located under the observation windows. Inlet channels provide fluid communication between respective inlet wells and detection wells, while outlet channels provide fluid communication between respective detection wells and outlet wells. The double-layer multi-well plate of the present invention decreases the risk of evaporation of the liquid in the detection wells, and decreases air bubble formation in the detection wells during small-volume liquid handling.

Therefore, an aspect of some embodiments of the present invention relates to a multi-well plate comprising: (a) a plurality of inlet wells having upper apertures and configured to receive a liquid via the upper apertures and to contain the liquid; (b) a plurality of walled observation windows located between the inlet wells, each observation window being associated with a respective inlet well; (c) a plurality of detection wells, each detection well being disposed below a respective observation window, being covered by the respective observation window, and being associated with the respective inlet well associated with the respective observation window; (d) a plurality of outlet wells located between the inlet wells and the observation windows, each outlet well being associated with a respective inlet well and a respective detection well; (e) a plurality of inlet channels, disposed in first groups of one or more inlet channels, each first group providing fluid communication between an inlet well and a respective detection well; (f) a plurality of outlet channels, disposed in second groups of one or more outlet channels, each second group providing fluid communication between a detection well and a respective outlet well. The inlet channels are configured to prevent passage of the liquid from the inlet wells to the respective detection wells if a force smaller than a threshold force is applied to the liquid in each inlet well in a direction of each respective inlet channel.

In some embodiments of the present invention, the multi-well plate comprises a horizontal sheet. The inlet wells are disposed on the planar base and have first walls extending upward from the sheet. The detection wells are disposed below the sheet. The observation windows are surrounded by second walls extending upward from the sheet. The outlet wells are outside the first walls and the second walls. The inlet channels and the outlet channels traverse the sheet.

In a variant, at least one of the inlet channels comprises a first section that traverses the sheet and a second section extending under the sheet from the first section to a respective detection well.

In another variant, at least one of the outlet channels comprises a first section that traverses the sheet and a second section extending under the sheet from the first section to a respective detection well.

In yet another variant, the multi-well plate comprises an upper sheet and a lower sheet. The upper sheet comprises the horizontal sheet. The detection wells are inset on the lower sheet. The upper sheet is placed on a top surface of the lower sheet.

In some embodiments of the present invention, the detection wells have first and second portions that are wider than the respective walled observation windows, the first portions extending under the respective inlet wells and the second portions extending under the respective outlet well. Each inlet channel is a first gap at a bottom base of a respective inlet well, configured to connect the respective inlet well to the first portion of the respective detection well. Each outlet channel is a second gap at a bottom base of a respective outlet well, configured to connect the respective outlet well to the second portion of the respective detection well.

In a variant, the bottom base of at least one of the inlet wells is tilted downward toward the first portion of the respective detection well.

In another variant, the bottom base of at least one of the outlet wells is tilted downward toward the first portion of the respective detection well.

In a variant, at least one of the observation windows is planar and parallel to a base of the of the respective detection well.

In another variant, at least one of the observation windows is transparent to visible light.

In yet another variant, a base of at least one the detection wells is transparent to visible light.

In a further variant, a wall of at least one the detection wells is opaque to visible light.

In yet a further variant, a wall of at least one the detection wells is transparent to visible light.

In a variant, the multi-well plate includes a plurality of separation walls configured to separate the plurality of outlet channels from each other.

In another variant, the inner channels have horizontal dimensions in the range between 0.1 and 0.9 mm.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
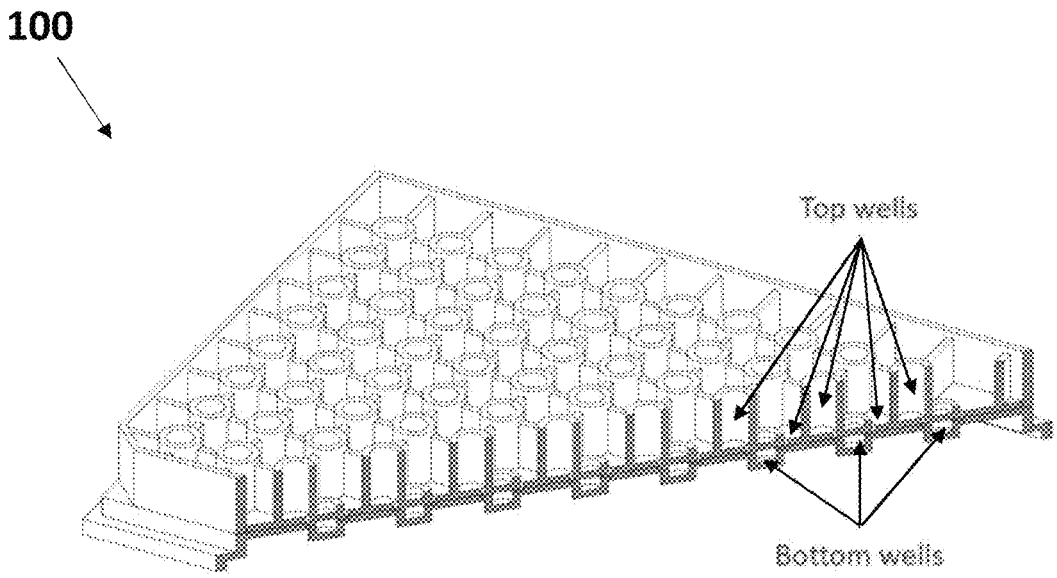
FIG. 1 is a perspective view of a multi-well plate comprising a horizontal sheet, according to some embodiments of the present invention.
Figure 2:
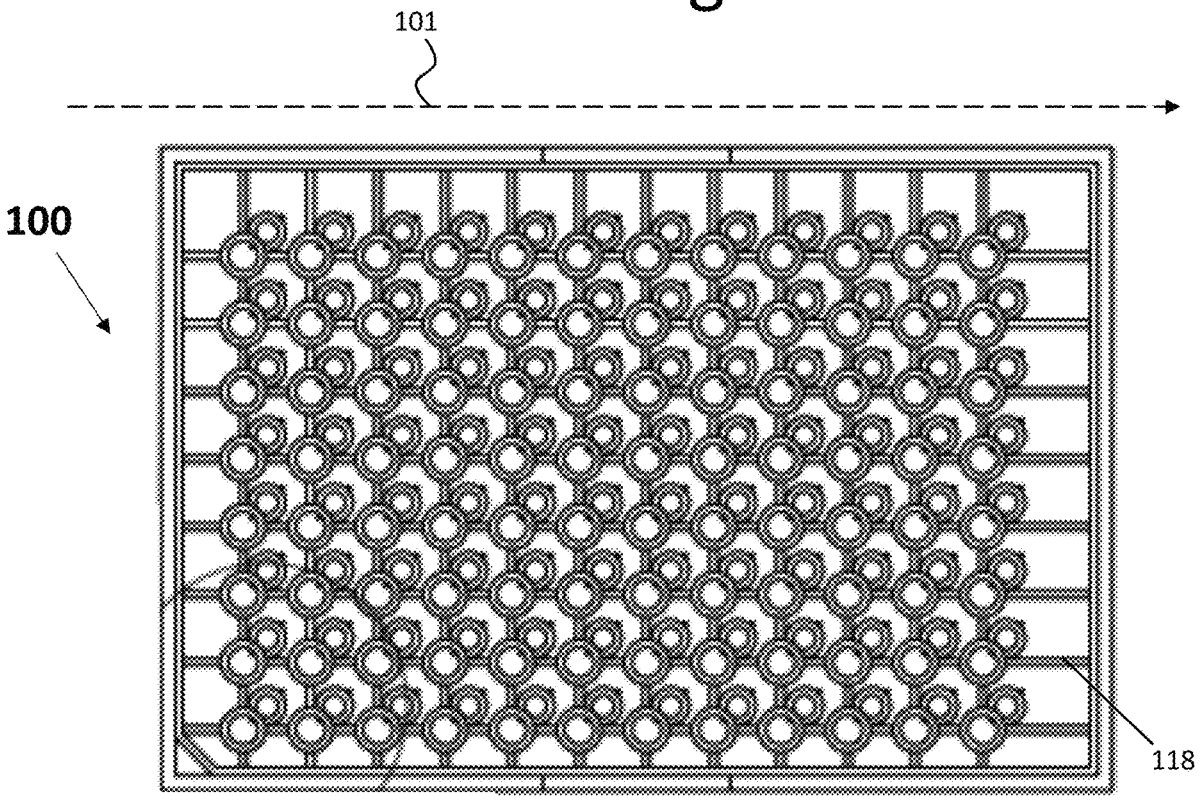
FIG. 2 is a top view of the multi-well plate of FIG. 1, according to some embodiments of the present invention.
Figures 3, 4:
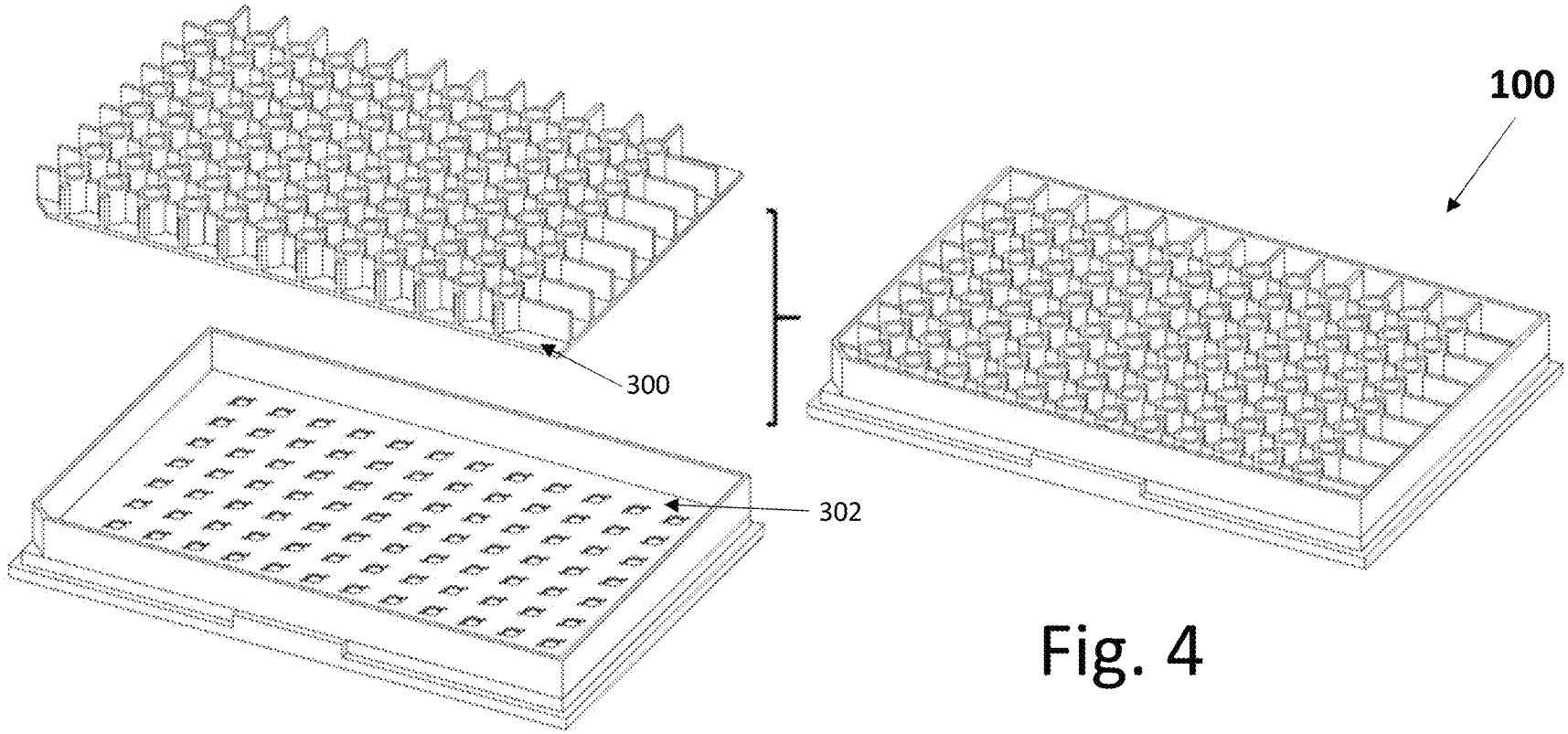
FIG. 3 is an exploded view of a multi-well plate having an upper sheet and a lower sheet, according to some embodiments of the present invention.
FIG. 4 is a perspective view of the multi-well plate of FIG. 3 in assembled for, according to some embodiments of the present invention.
Figure 6:
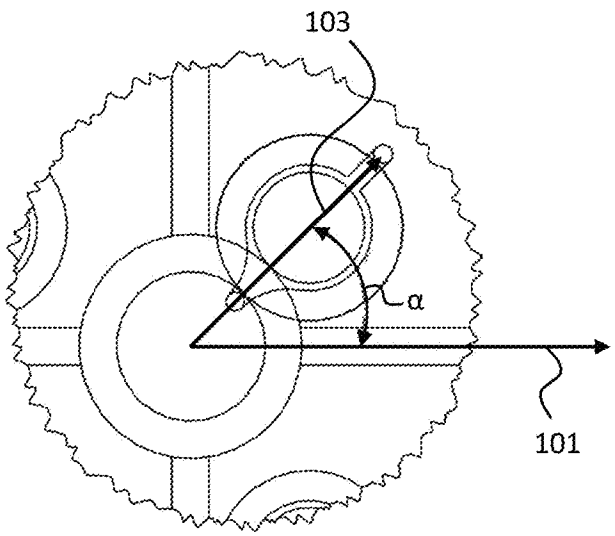
FIG. 6 is a top view of the superposition of the details of the upper sheet and lower sheet of the FIG. 5, according to some embodiments of the present invention.
Figure 5:
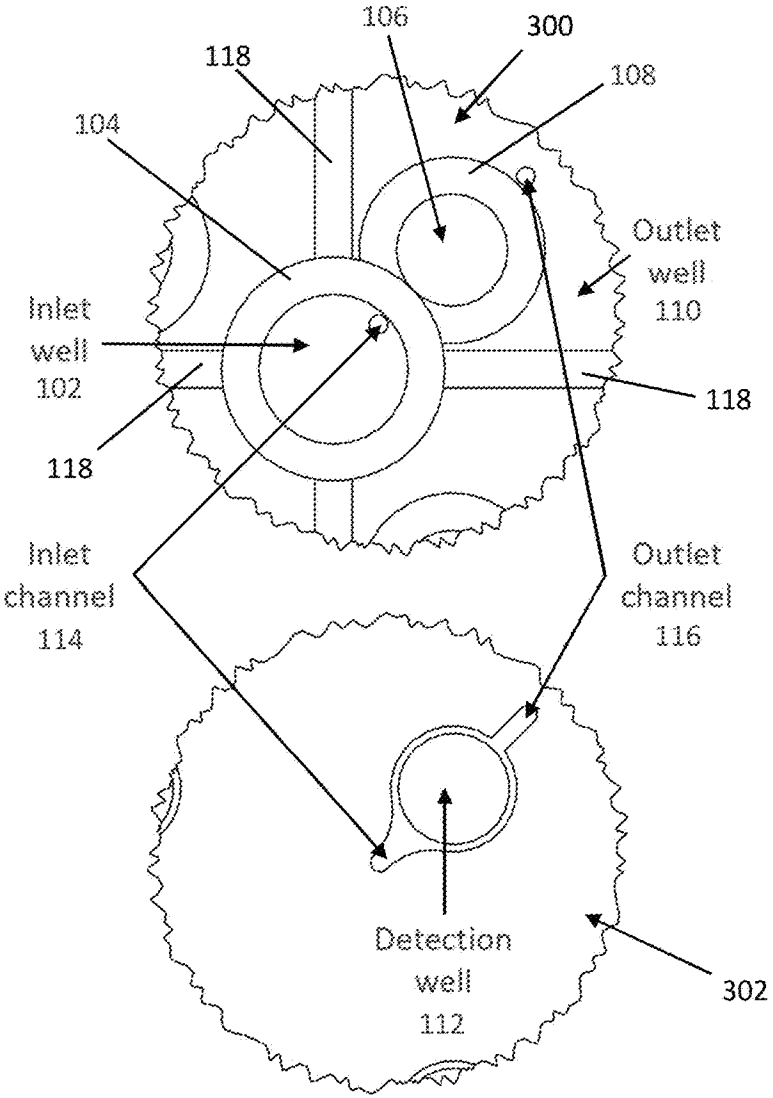
FIG. 5 is a top view of a detail of the upper sheet and the lower sheet of the multi-well plate of FIG. 3, according to some embodiments of the present invention.
Figure 8:
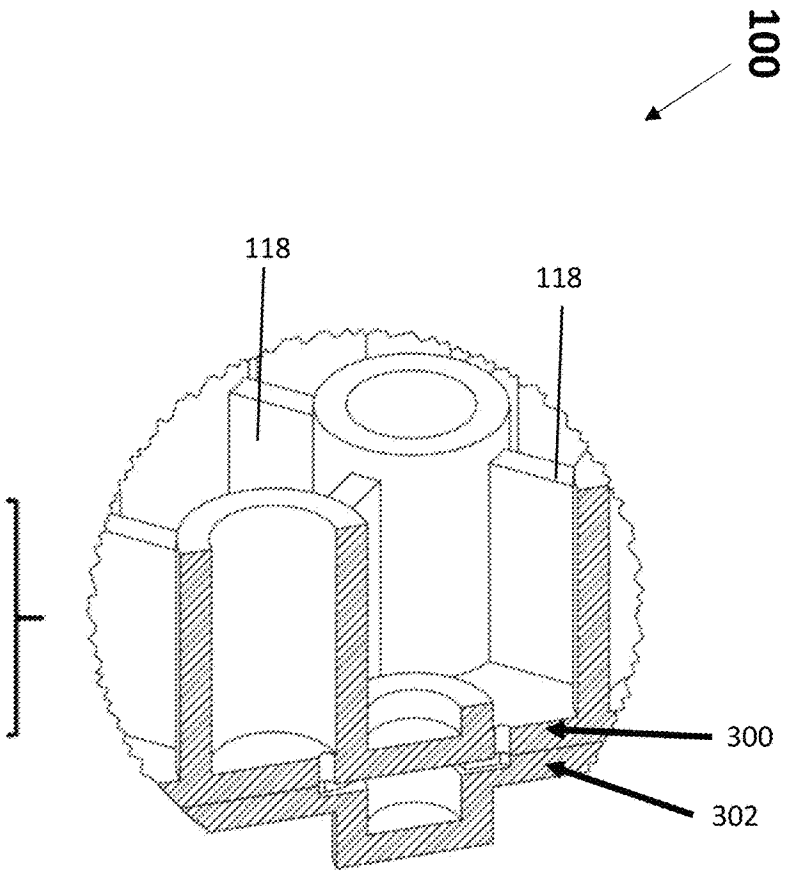
FIG. 8 is a perspective sectional view of a detail of the multi-well plate of FIG. 3, according to some embodiments of the present invention.
Figure 7:
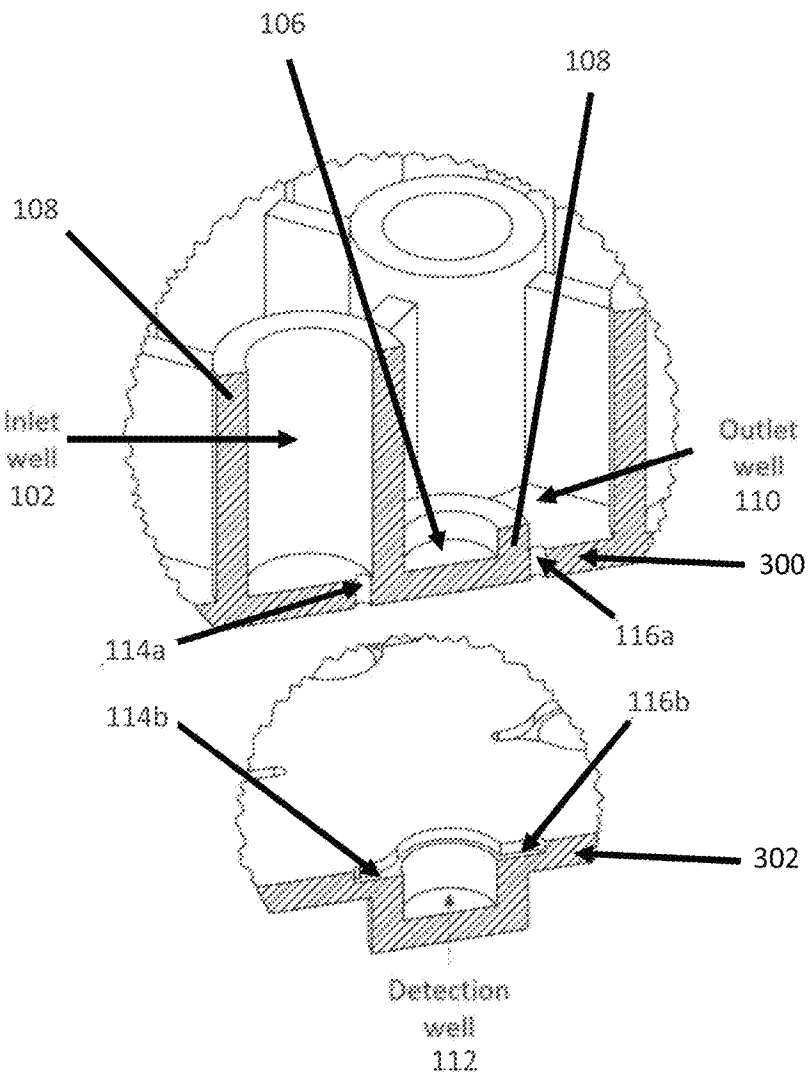
FIG. 7 is an exploded perspective sectional view of a detail of the multi-well plate of FIG. 3, according to some embodiments of the present invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Reference is now made to FIGS. 1-10 which illustrate many views and details of a multi-well plate 100 of some embodiments of the present invention, in which the detection wells (bottom wells) are separated from the inlet wells and the outlet wells (both types of wells being upper wells) by a planar sheet.

The multi-plate 100 includes a plurality of inlet wells 102, a plurality of walled observation windows 106, a plurality of detection wells 112, a plurality of outlet wells 110, a plurality of inlet channels 114, and a plurality of outlet channels 116.

Each inlet well 102 has a first wall 104 and a respective upper aperture 102*a*. Each inlet well 102 is configured to receive a liquid and contain the liquid with first walls. The liquid may include a base liquid and a reagent, which may be introduced separately into the inlet well. In some embodiments of the present invention, the inlet wells are set in a matrix configuration of rows and columns, such that a pipetting robot can be used to fill a plurality of inlet wells 102 at once.

The observation windows 106 are closed windows include second walls 108, which will be discussed further below. The detection wells 112 are located under respective observation windows 106 and are covered by the respective observation windows 106. The observation windows are configured to cover the detection wells 112 in order to decrease evaporation in the liquid inside the evaporation wells, while allowing the liquid in the observation wells to be observed therethrough via electromagnetic radiation. This, the observation windows 106 are transparent to the electromagnetic radiation. If the electromagnetic radiation used for observation of the liquid is visible light, the observation windows are transparent to visible light. In some embodiments of the present invention, the bases (bottom portions, or bottom floors) 112*a* of detection wells 112 are also transparent to the electromagnetic radiation used for observing the liquid therein. In this manner, the path of the electromagnetic radiation from the liquid to the detection device located above the multi-well plate is not affected by the lack of transparency (e.g., color) of the detection well 112 and provides clear imaging of liquids by detection devices. In some embodiments of the present invention, each detection windows 106 and the base 112*a* of the respective detection well 112 are planar and parallel to each other. This provides a fixed optical path difference in the detection well 112 for accurate and repeatable liquid detection. In some embodiments of the present invention, the wall 112*b* of the detection well is opaque to the electromagnetic used in the observation of the liquid. This prevents potential crosstalk during photometric reading, so that the color of liquid in one detection well is not affected by the color of the liquid in other detection wells. This is generally required for assays with high imaging requirement. It should be noted that the wall 112*b* of the detection well may be transparent instead of opaque, and this is acceptable for an assay with relatively low imaging requirement.

The outlet wells 110 are located outside the inlet wells 102 and outside the second wall 108 surrounding the observation windows 106. Each inlet well 102 is associated with a respective observation window 106, a respective outlet well 110, and a respective detection well 112. One or more inlet channels 114 provide fluid communication between an inlet well 102 and the respective detection well 112. One or more outlet channels 116 provide fluid communication between a detection well 112 and the respective outlet well 110. It should be noted that the outlet wells 110 may be separated from other outlet channels 116 by separation walls 118, in order to prevent cross-contamination of the liquid between different detection wells 112. For example, if the outlet wells 110 were not separated, the liquids from different outlet wells 110 would mix. Because outlet wells 110 in a fluid communication with respective detection wells 112 via the respective outlet channels 116, a mixing of liquids from different outlet wells 110 could cause cross-contamination between different detection wells 112. Besides preventing cross-contamination the separation walls 118 provide structural rigidity to the multi-well plate, preventing undesired bending and warping during production and operation.

The inlet channels 114 are sized to prevent passage of the liquid from the inlet wells 102 to the respective detection wells 112 if no external force (other than gravity) is applied to the liquid. In other words, a force having a magnitude larger than a threshold magnitude need to be applied to the liquid in an inlet well 102 in the direction of the respective inlet channel(s) 114, in order to the liquid to pass through the respective inlet channel(s) 114 into the respective detection well 112. Interfacial tension between liquid and air, between air and the surface of the inlet channel, and between the surface of the inlet channel 114 and the liquid prevents the passage of the liquid into the small-sized inlet channels 114. It is clear that the magnitude of the external force necessary to drive the liquid from the inlet well 102 to the respective detection well 112 through the respective inlet channel(s) 114 depends on properties of the liquid 120 and of the material of the multi-well plate 100 and on the geometry of the inlet channels 114. However, a non-limiting examples provided by experiments conducted by the inventors of the present invention indicate that a water-like liquid is pushed from an inlet well 102 through an inlet channel 114 having diameter of 0.3-0.6 mm in a multi-well plate 100 made of a PS-like thermoplastic to fill a detection well 112 if a force 202 applied to the liquid has a magnitude that is 200-400 times larger than the Earth's gravitational force on the surface of Earth for about 1-4 minutes. This can be achieved, for example by using a centrifuge 200 turning at 100 to 3000 rotation per minute (RPM).

Figure 15:
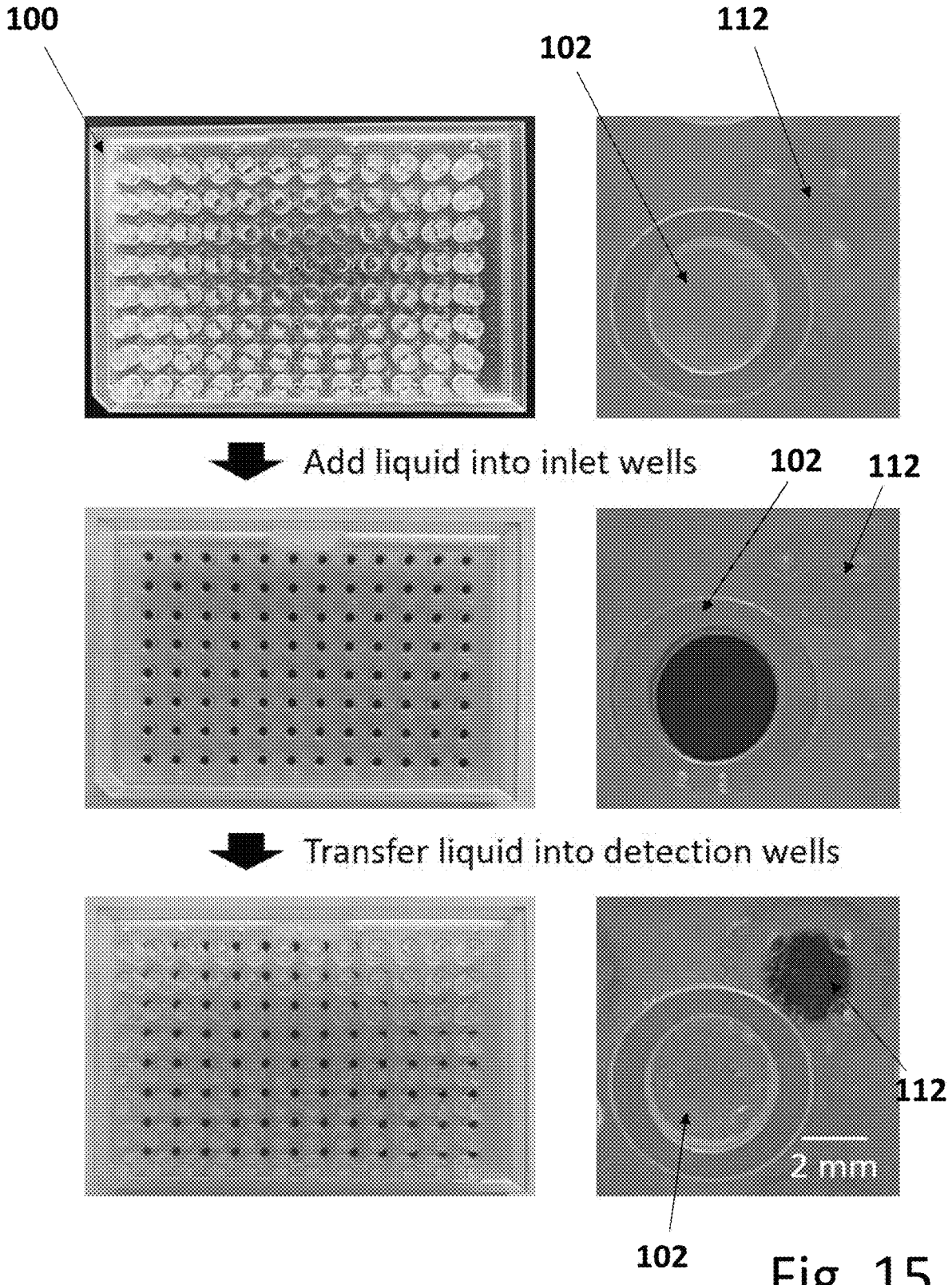
FIG. 15 are photographs documenting results of a first experiment conducted by the inventors to assess the properties of multi-well plates of the present invention.
Figure 16:
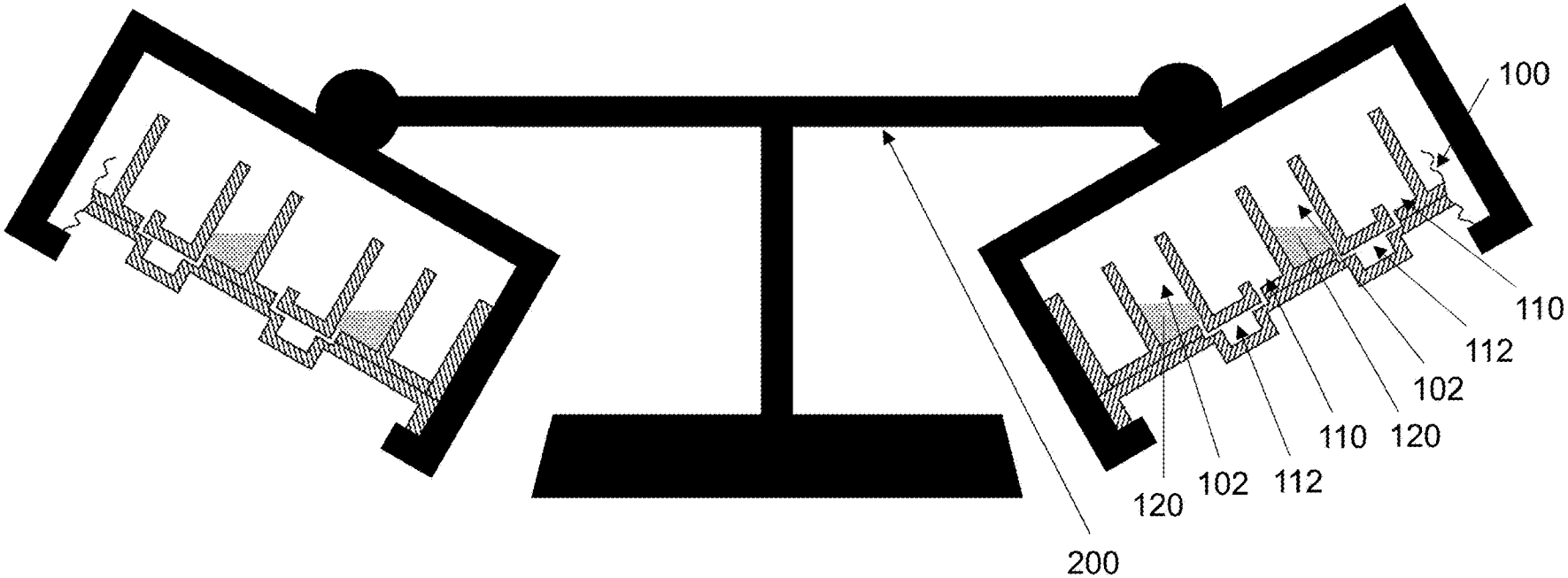
FIGS. 16-19 are schematic drawings showing different stages of the use of the multi-well plate, according to some embodiments of the present invention.
Figure 17:
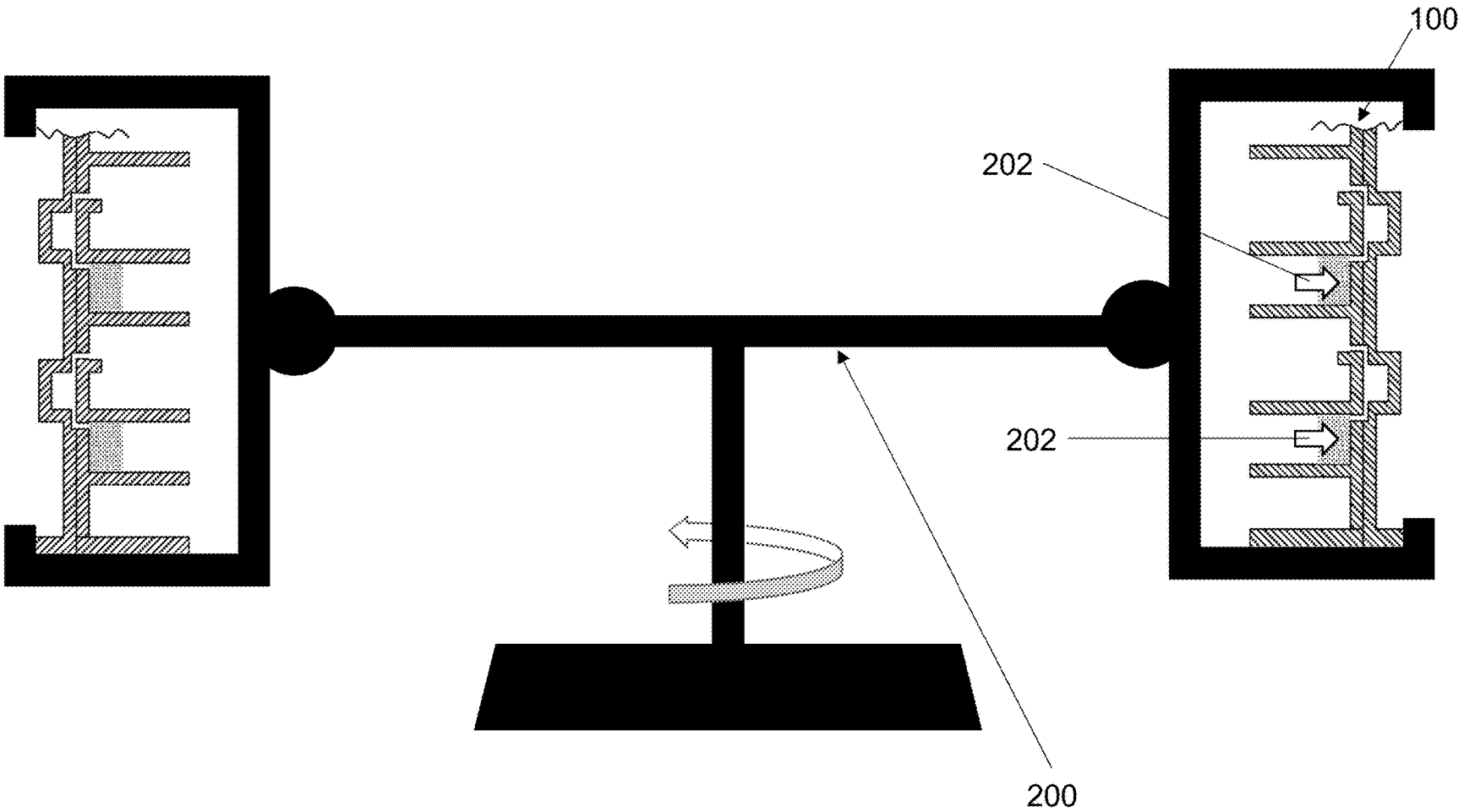
Figure 18:
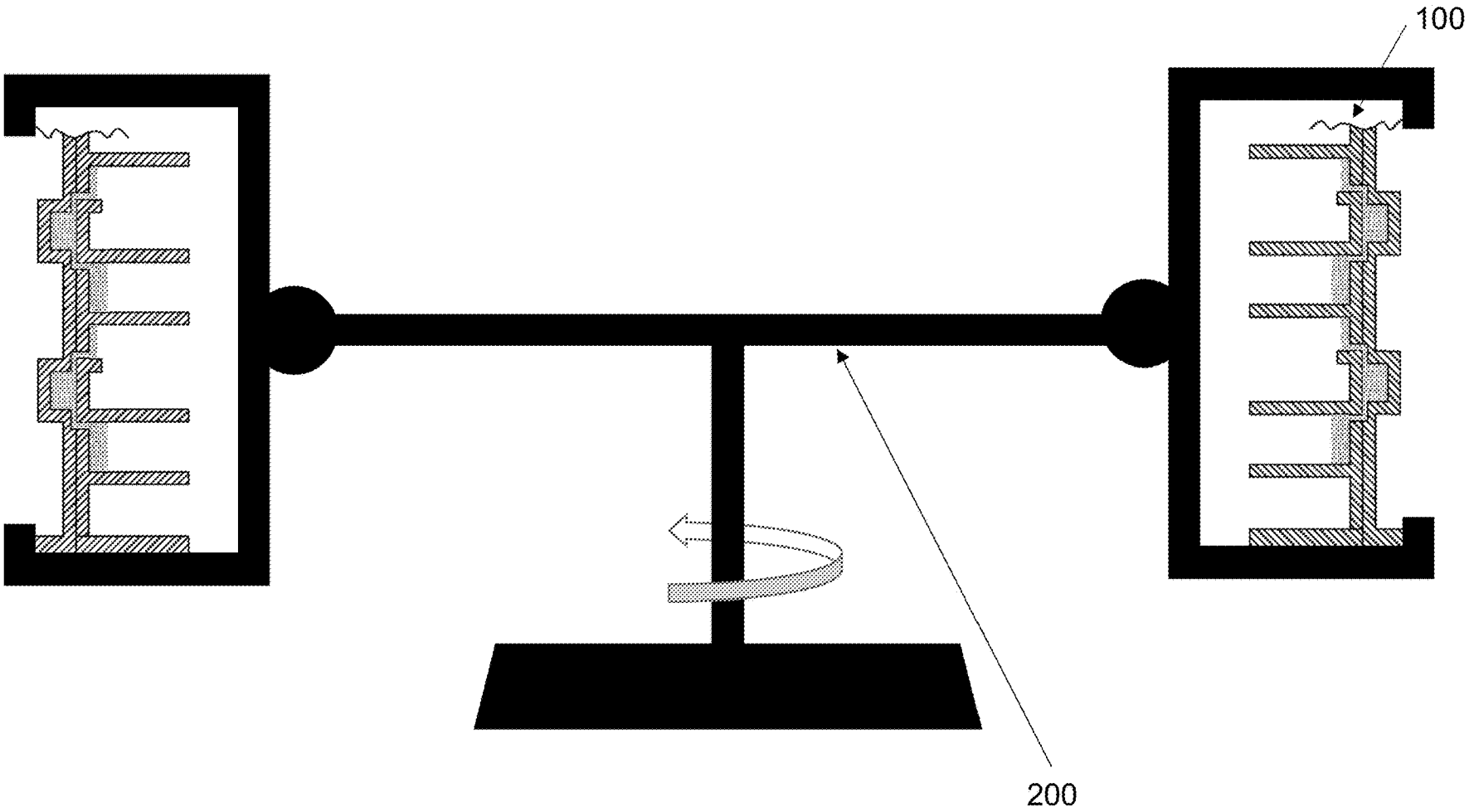

In use, as shown in FIG. 15, a liquid 120 is placed into one or more inlet wells 102. Force is applied to the liquid in the inlet wells 102 to drive the liquid 120 into the detection wells 112 via the inlet channels 114. The force may be applied by applying high pressure to the liquid 120 via a pipetting robot, or via a centrifuge 200 (as shown in FIGS. 16-18). If a centrifuge is used, the multi-well plate 100 is placed in the centrifuge 200 in FIG. 16. The multi-well plate may be placed in the centrifuge 200 horizontally, however, in some cases the multi-well plate 100 can be tilted so that the multi-well plate 100 is no longer horizontal. The height of the first walls 104 of the inlet wells 102 is chosen to eliminate spillage of the liquid 120 from the inlet wells 102.

In FIG. 17, the centrifuge 200 rotates, applying centrifugal force (denoted by the arrows 202) to the liquid 120. As shown in FIGS. 17-18, the multi-well plate will be tilted to ~90 degrees or in vertical orientation by centripetal force of the rotor. As a result, the liquid 120 is subjected to the pressure by the centrifugal force of the rotor and the liquid 120 is pushed into the detection wells 112, from the inlet wells 102 via the inlet channels 114. The air in the detection wells 112 exits via the outlet channels 116. In this manner, no bubbles appear in the detection well 112, that may adversely affect proper observation of the liquid inside the detection well 112.

Still in FIG. 18, while the external (centrifugal) force pushes the liquid 120 from the inlet well 102 into the detection wells 112, some excessive liquid 120 may exit the detection wells 112 via the outlet channels 116 into the outlet wells 110. Due to the separation of the outlet well 110 from the observation window 106, the liquid in the outlet well 110 does not fall on the observation window 106, thus keeping the observation window 106 clear and allowing the liquid 120 to be properly observed in the detection well 112 via the observation window 106.

When the detection well 112 is full, some liquid is kept inside the inlet channel 114 and the outlet channel 116—which are very small. This decreases the exposure of the liquid 120 in the detection well 112 to the outside environment and therefore greatly decreases evaporation of the liquid inside the detection well 112. Thus, the liquid 120 is still pressed against the observation window 106 for a long time and can be observed even a long time after it is introduced into the detection well 112.

Figure 19:
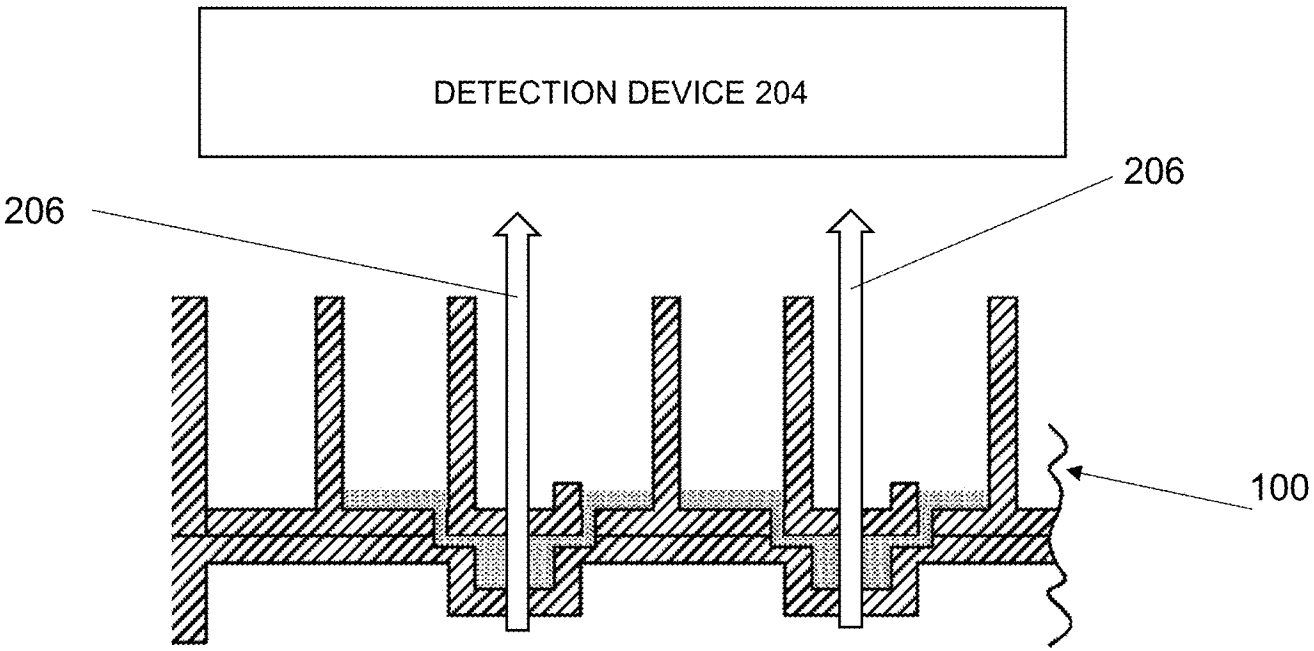
Figures 20, 21:
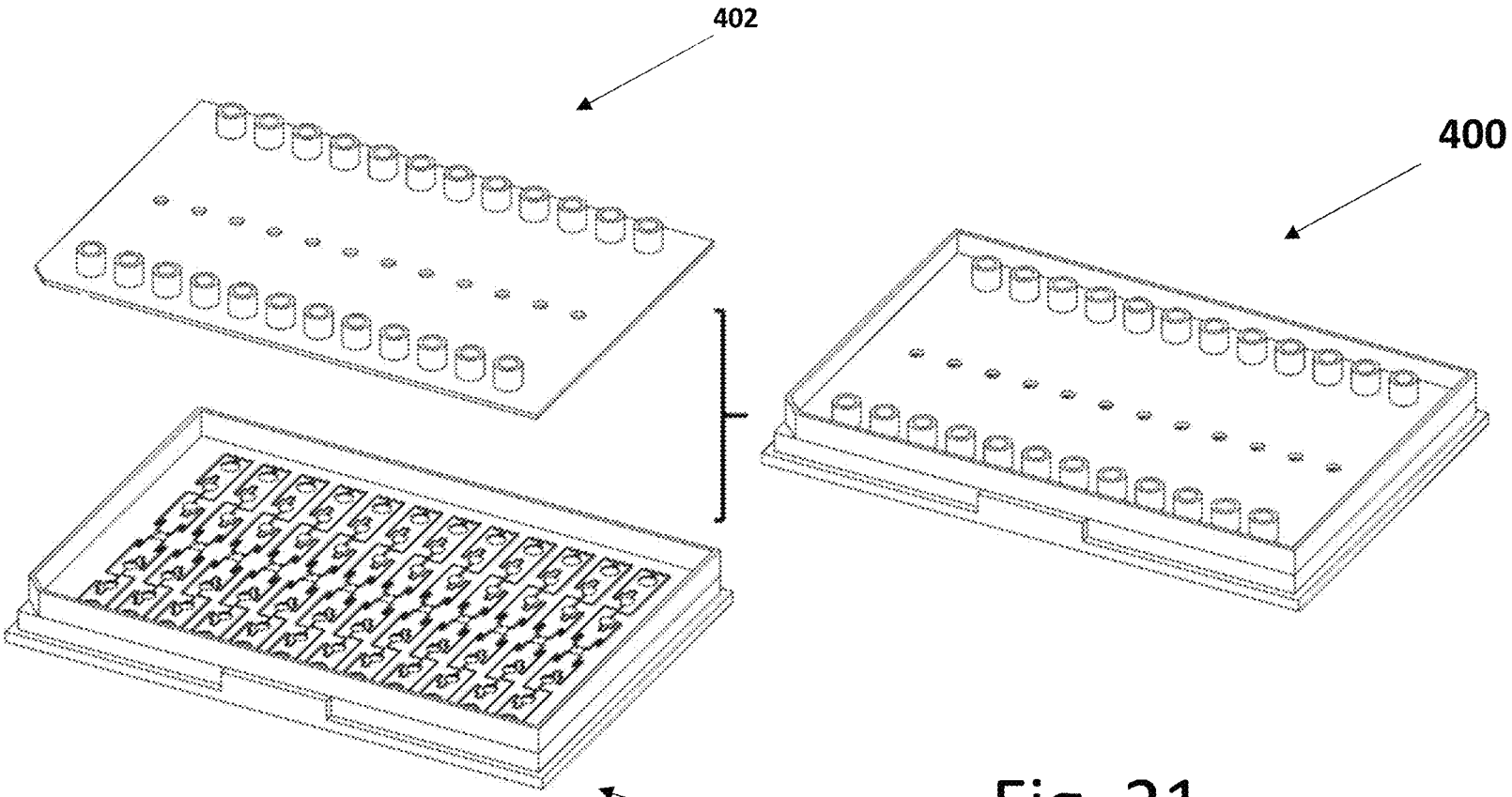
FIG. 20 is an exploded perspective view illustrating a multi-well plate in which a single outlet well is connected to a plurality of respective detection wells, according to some embodiments of the present invention.
FIG. 21 illustrates the multi-well plate of FIG. 20 in assembled form, according to some embodiments of the present invention.
Figure 23:
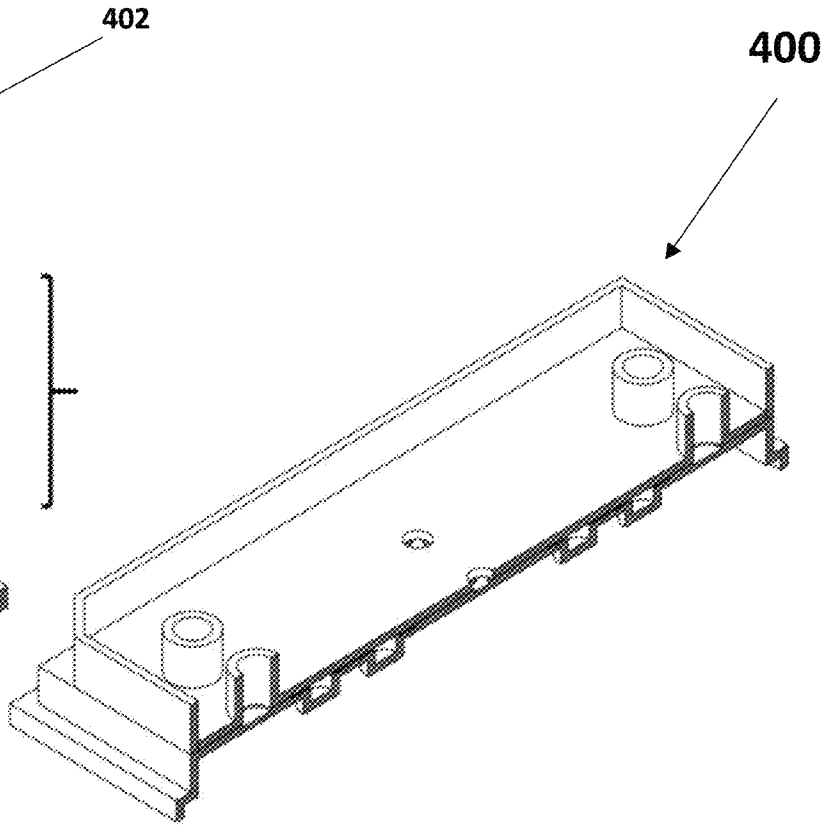
FIG. 23 illustrates the portion of the multi-well plate of FIG. 22 in assembled form, according to some embodiments of the present invention.
Figure 22:
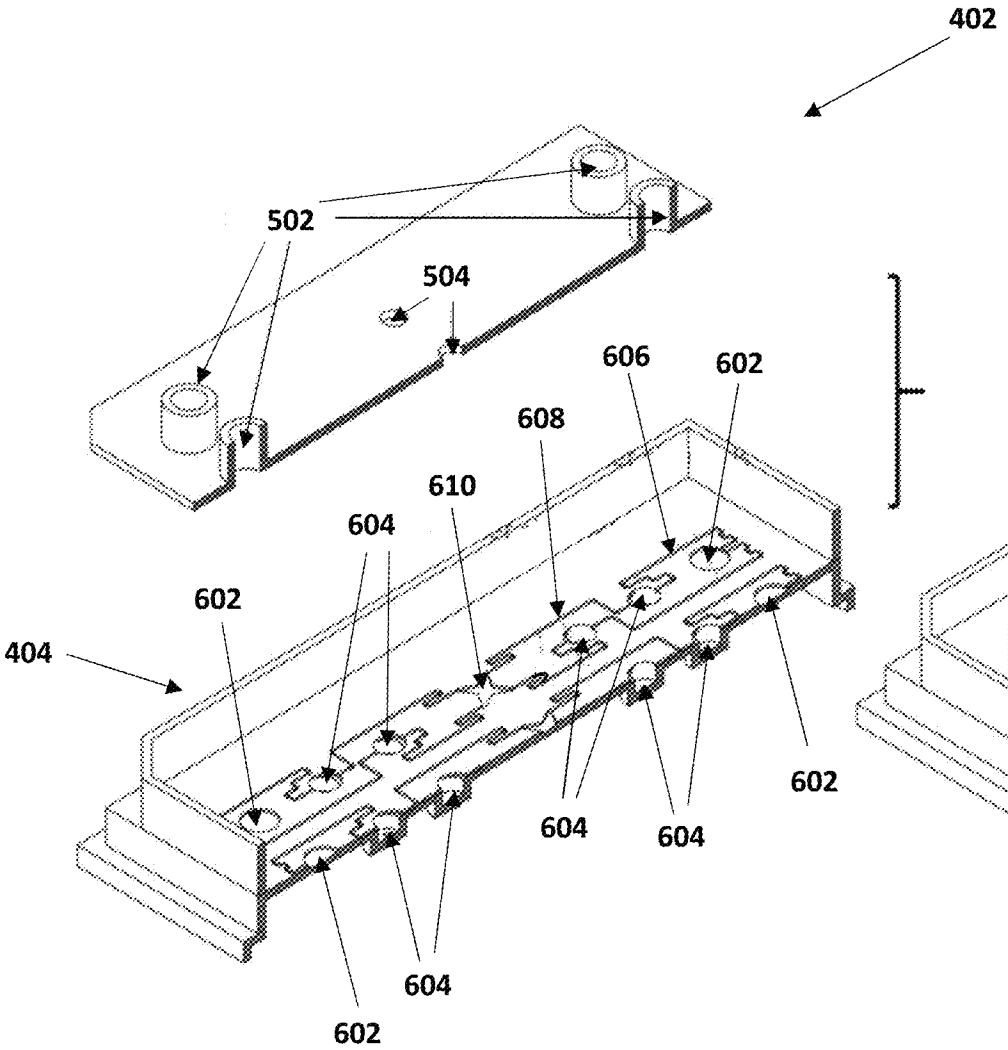
FIG. 22 is an exploded perspective view illustrating a portion of the multi-well plate of FIG. 20, according to some embodiments of the present invention.

In FIG. 19, the multi-well plate 100 is returned to the horizontal orientation and observed via a detection device 204. The propagation path of the electromagnetic radiation 206 (e.g., light) from the liquid 120 in the detection wells 112 to the detection device 204 is not impeded by bubbles or liquid on the observation window 106. Moreover, due to the decreased exposure of the liquid 120 in the detection wells 112 to the external environment, evaporation of the liquid 120 inside the detection wells 112 is minimal, which decrease the loss of liquid in the detection wells 112. This allows time for chemical and/or biological reactions to occur in the detection wells 112 without loss of liquid therein, and allows observation of changes in the liquid due to the chemical and/or biological reaction over time. Moreover, because of the decrease in evaporation, the amount of liquid in the detection wells 112 does not change over longer periods of time such as hours to days, Adding small volume of mineral oil in the inlet well 102 and outlet well 110 completely eliminates the air contact and prolong the time period in which the liquid 120 is kept in the detection well 112 without evaporating even more (for example up to more than a month), thereby making sure that the liquid 120 in the detection wells 112 contact the bottom of the respective observation windows 106, thereby maintaining a constant optical path through the liquid 120 in the detection wells 112 over longer time periods.

The multi-well plate 100 of the present invention may be used for a variety of liquid handling processes, such as (but not limited to) liquid washing which is an essential step in molecular-based assay including ELISA. Moreover, liquid inclusions, such as cells, can be transferred into the detection well for further culturing and subsequent drug treatment.

In some embodiments of the present invention, the multi-well plate 100 includes a planar horizontal sheet 300. The inlet wells 102 are disposed on the sheet and have first walls 104 extending upward from the sheet. The observation windows 106 are part of the sheet 300 and are surrounded by second walls 108 extending upward from the sheet 300. The outlet wells 110 are disposed on the sheet 300. The detection wells 112 are disposed below the sheet 300. The inlet channels 114 and the outlet channels 116 include perforations that traverse the sheet 300.

In some embodiments of the present invention, the perforations that travers the sheet 300 lead directly from the inlet wells 102 and from the outlet wells 110 to the respective detection wells 112. In some embodiments of the present invention, at least one of the inlet channels 114 has an L-shape, and includes a first section 114*a* which traverses the sheet 300 in the inlet well 102 and a second section 114*b* that extends under the sheet and leads from the first section 114*a* to the respective detection well 112. In some embodiments of the present invention, at least one of the outlet channels 116 has an L-shape, and includes a first section 116*a* which traverses the sheet 300 in the outlet channel 110 and a second section 116*b* that extends under the sheet and leads from the first section 116*a* to the respective detection well 112.

In some embodiments of the present invention, the multi-well plate includes an upper sheet and a lower sheet. The upper sheet includes the planar sheet 300. The detection wells 112 (and the second sections 114*a* and 116*a*, if present) are inset in lower sheet. The multi-well plate 100 is formed when the planar sheet is joined to the upper surface of the lower sheet 300, as seen, for example in FIGS. 3-4 and 7-8.

In some embodiments of the present invention, the sheet 300 is a plane that extends along a longitudinal axis 101 parallel to the rows of inlet wells 112. In some embodiments a second axis 103 connects the center of an inlet well 112 with the center of the respective observation window 106. The angle between the axes 101 and 103 is a. In a non-limiting example of the present invention, the angle $\alpha$ is 45 degrees, which allows better space utilization and the fitting of more inlet wells 102 and detection wells 112 over the multi-well plate 100. The scope of the present invention extends to any other value of the angle $\alpha$.

The shape of the wells 102, 110, and 112, and of the observation window 106 may be selected according to the need of the user. The shape may be, for example, cylindrical with a circular, oval, or irregular base section, or may be a prism with a polygonal base, or may be frusto-conical.

Figure 9:
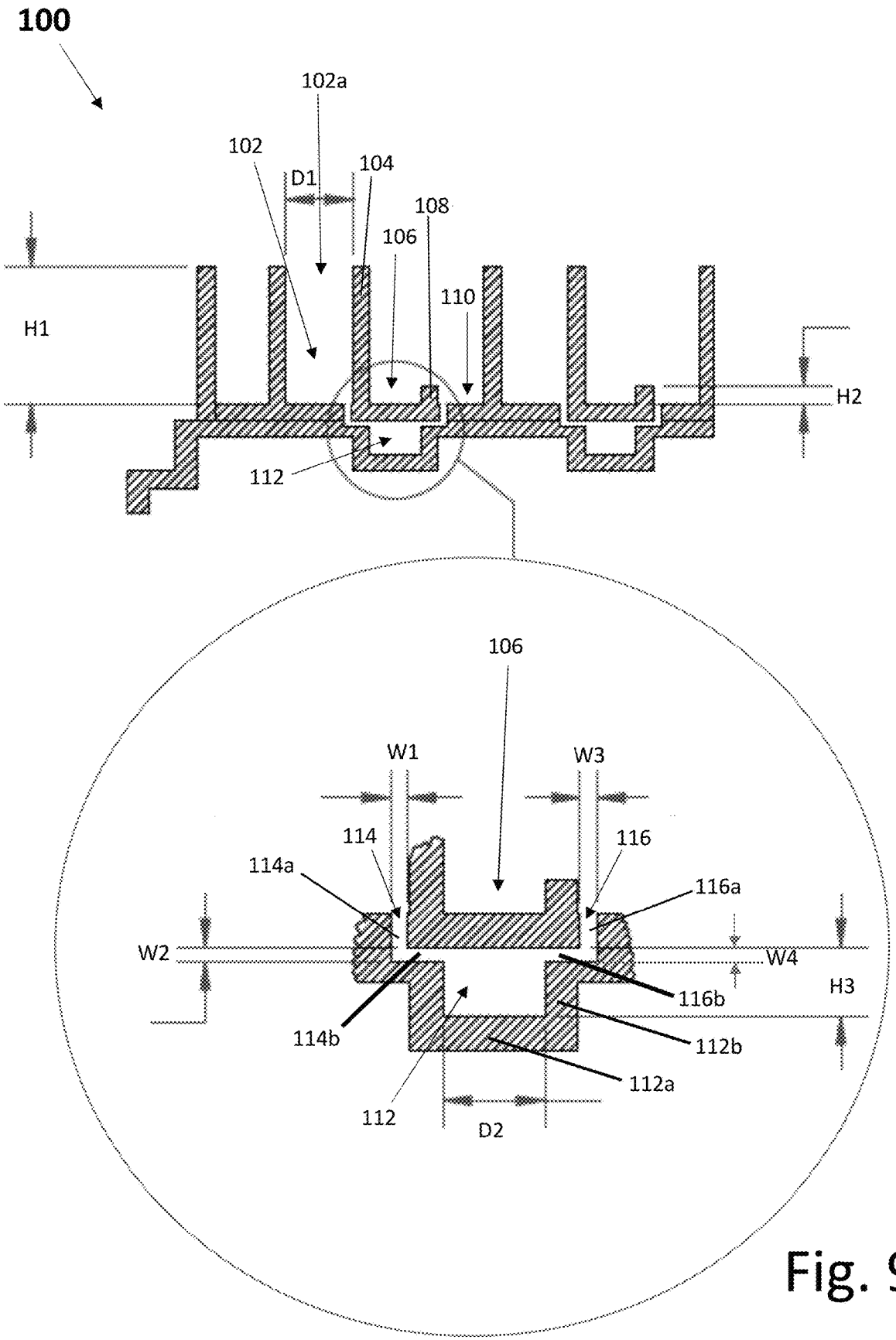
FIG. 9 is a cross-sectional side view of a portion of the multi-well plate of FIG. 3, according to some embodiments of the present invention.

FIG. 9 shows an example of different dimensions of the multi-well plate 100. The walls 104 of the inlet wells 102 have a height H1 and horizontal dimension (diameter, average of the minor and major axes, width) D1. The height the second wall 108 separating the observation window 106 from the outlet well 110 is H2. The height of the detection well 112 is H3. The horizontal dimension (diameter, average of the minor and major axes, width) of the detection well is D2. The width of the first section 114*a* of the inlet channel is W1, while the width of the second section 114*b* of the inlet channel is W2. The width of the first section 116*a* of the outlet channel is W3, while the width of the second section 116*b* of the outlet channel is W4.

In a non-limiting example, H1 may be between 4 mm and 12 mm, D1 may be between 2 mm and 6 mm, H2 may be between 0.5 mm to 12 mm, H3 may be between 1 and 3 mm, D2 may be between 1.5 mm and 4.5 mm. W1 and W3 may be between 0.1 mm and 0.9 mm, while W2 and W4 may be between 0.1 mm and 0.7 mm. In some embodiments of the present invention these dimensions are constant within 10% along the whole multi-well plate.

Figure 10:
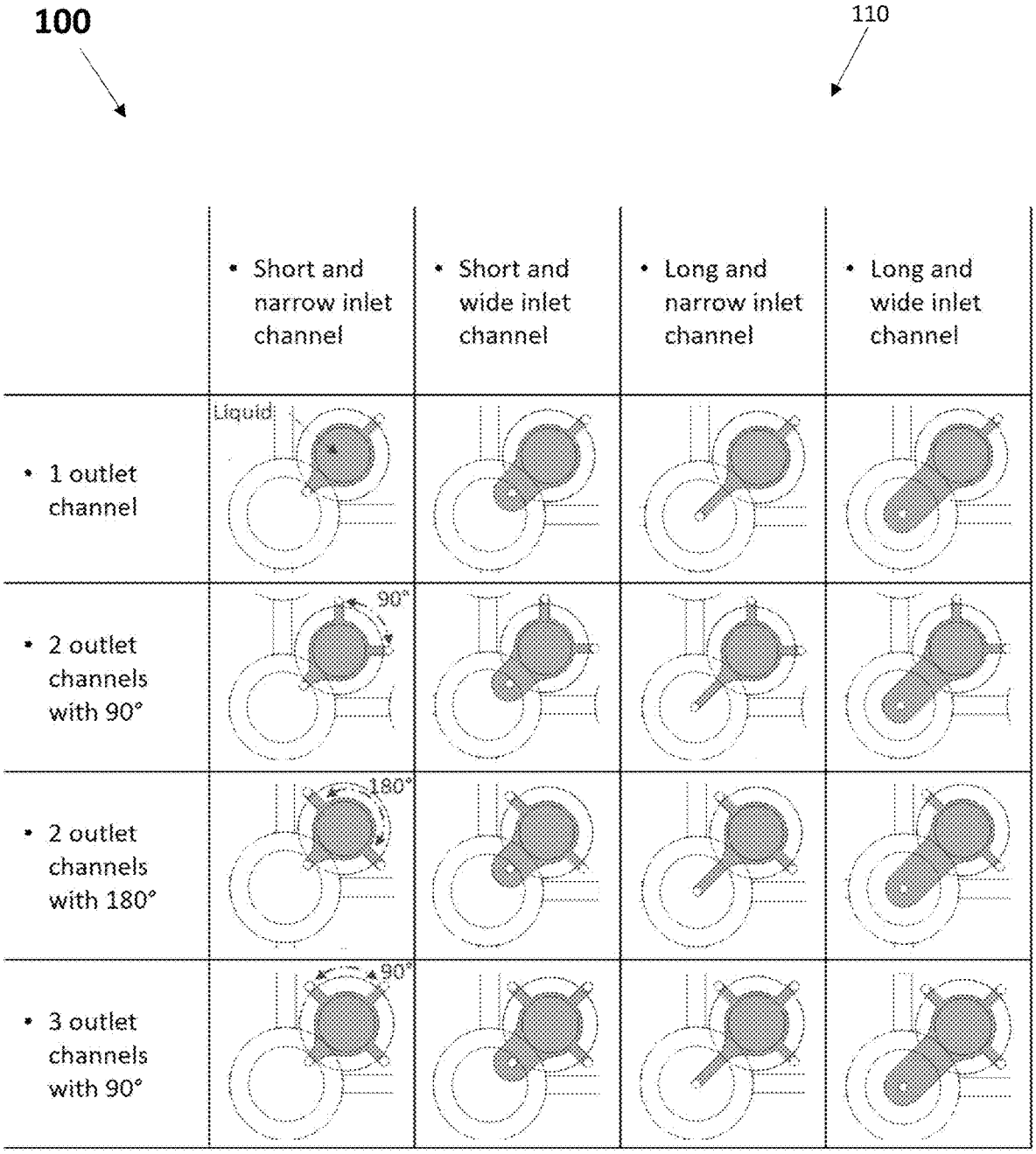
FIG. 10 is a table showing examples of configurations of inlet and outlet channels in a multi-well plate, according to some embodiments of the present invention.
Figure 11:
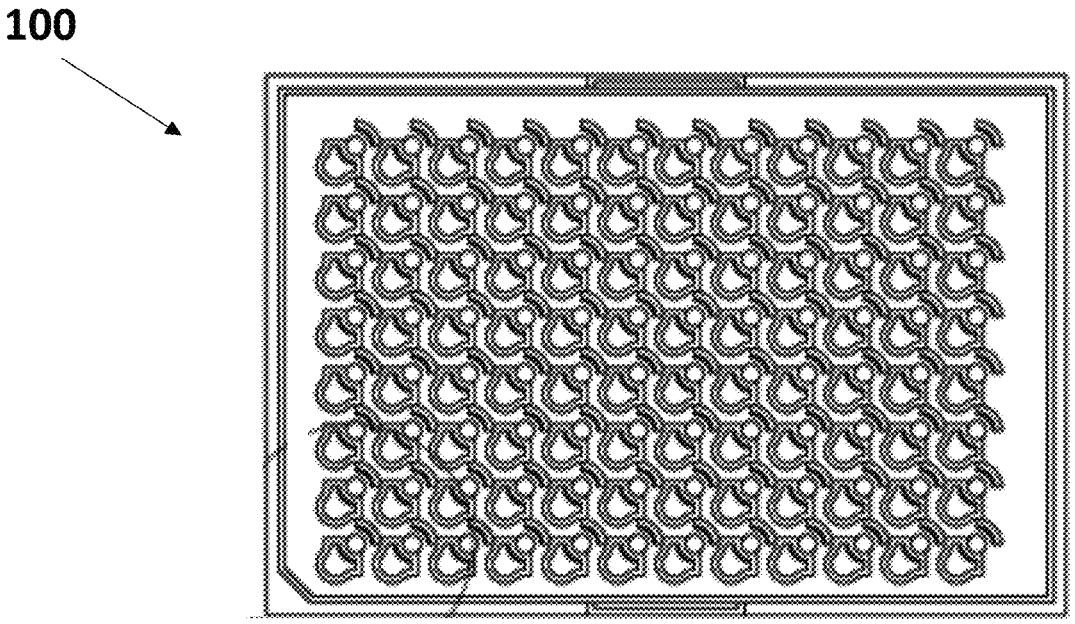
FIG. 11 is a top view of a multi-well plate, in which the detection well extends under portions of the inlet well and the outlet well, and inlet channel and the outlet channel are gaps, according to some embodiments of the present invention.
Figure 12:
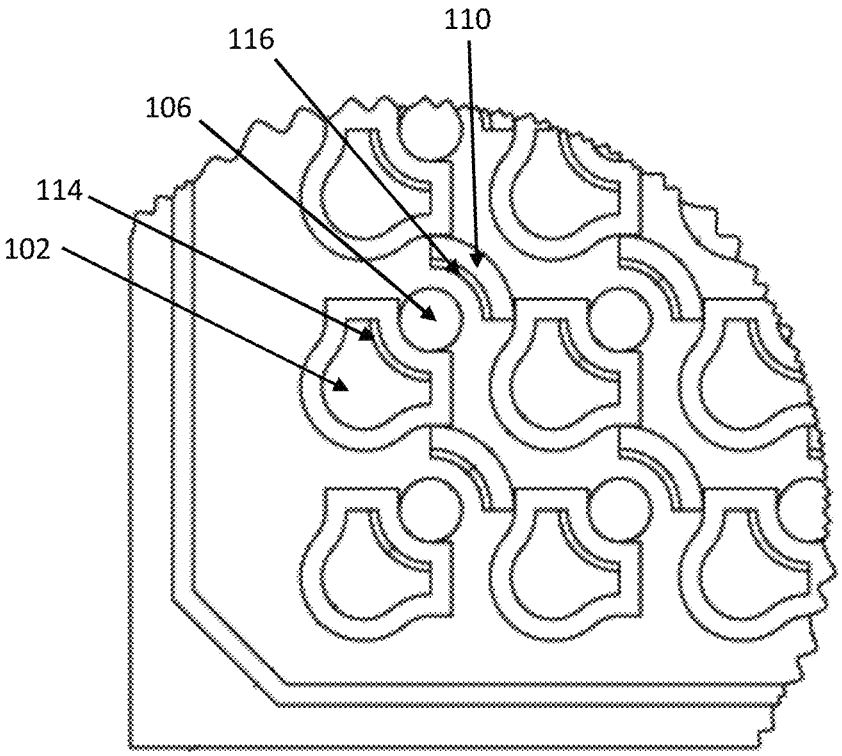
FIG. 12 is a top view of a detail of the multi-well plate of FIG. 11, according to some embodiments of the present invention.
Figure 13:
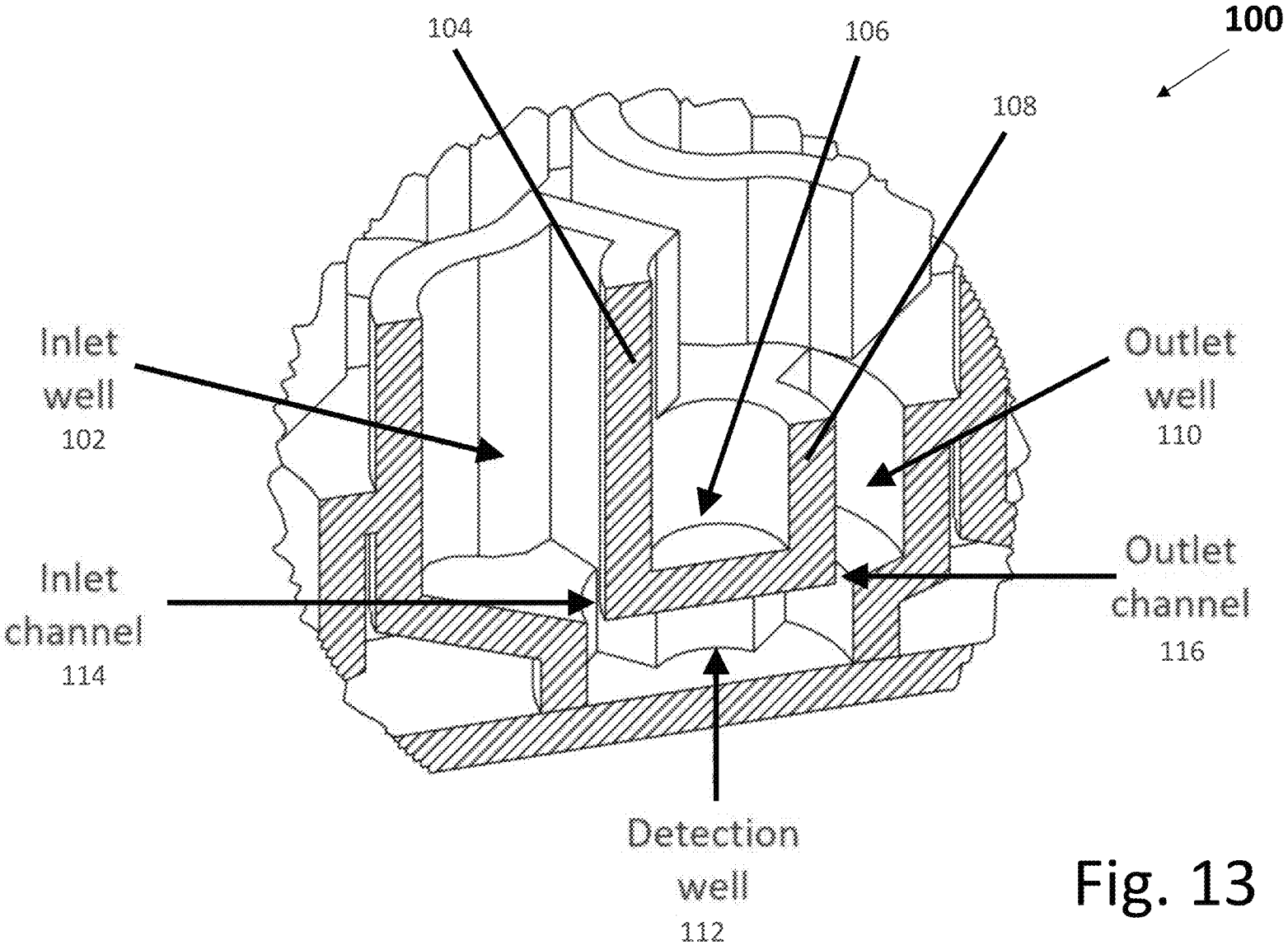
FIG. 13 is a perspective view of a detail of the multi-well plate of FIG. 11, according to some embodiments of the present invention.

The non-limiting examples of FIG. 10 are self-evident and show different configurations of the inlet and outlet channels, including long inlet channels, short inlet channels, wide inlet channels, narrow inlet channels, a plurality of outlet channels set at different angle between each other. It should be noted that the length and the width of the inlet channels applies to the second sections of the inlet channels travelling under the upper sheet. This is because the perforation of the upper sheet is small enough to prevent passage of liquid from the inlet well into unless forced by an external force (other than gravity). In some embodiments of the present invention, more than one inlet channel may be provided to connect an inlet well with the respective detection well.

FIGS. 11-14 illustrate different views of a multi-well plate 100 of the present invention in which the detection well 112 has a first portion which partially extends below the respective inlet well 102 and a second portion which partially extends under the respective outlet well 110. The inlet channel 114 is a first gap at the bottom of the inlet well 102, connecting the inlet well 102 to the respective detection well 112. The outlet channel 116 is a second gap at the bottom of the outlet well 110, connecting the outlet well 110 to the respective detection well 112.

In some embodiments of the present invention, the bottom end (bottom base, bottom floor) 105 of the inlet well 102 is tilted downward toward the inlet channel 114. The surface of the bottom end 105 may be planar or curved. In some embodiments, the angle β between the tilted bottom end 105 and the horizontal axis is between 0° and 40°.

In some embodiments of the present invention, the bottom end (bottom base, bottom floor) 111 of the outlet well 110 is tilted downward toward the outlet channel 116. The surface of the bottom end 111 may be planar or curved. In some embodiments, the angle δ between the tilted bottom end 111 and the horizontal axis is between 0° and 40°.

The multi-well plate 100 of FIGS. 11-14 may be constructed with an upper plane and a lower plane as explained above. In a variant, the multi-well plate 100 of FIGS. 11-14 is not constructed using two different planes.

Figure 14:
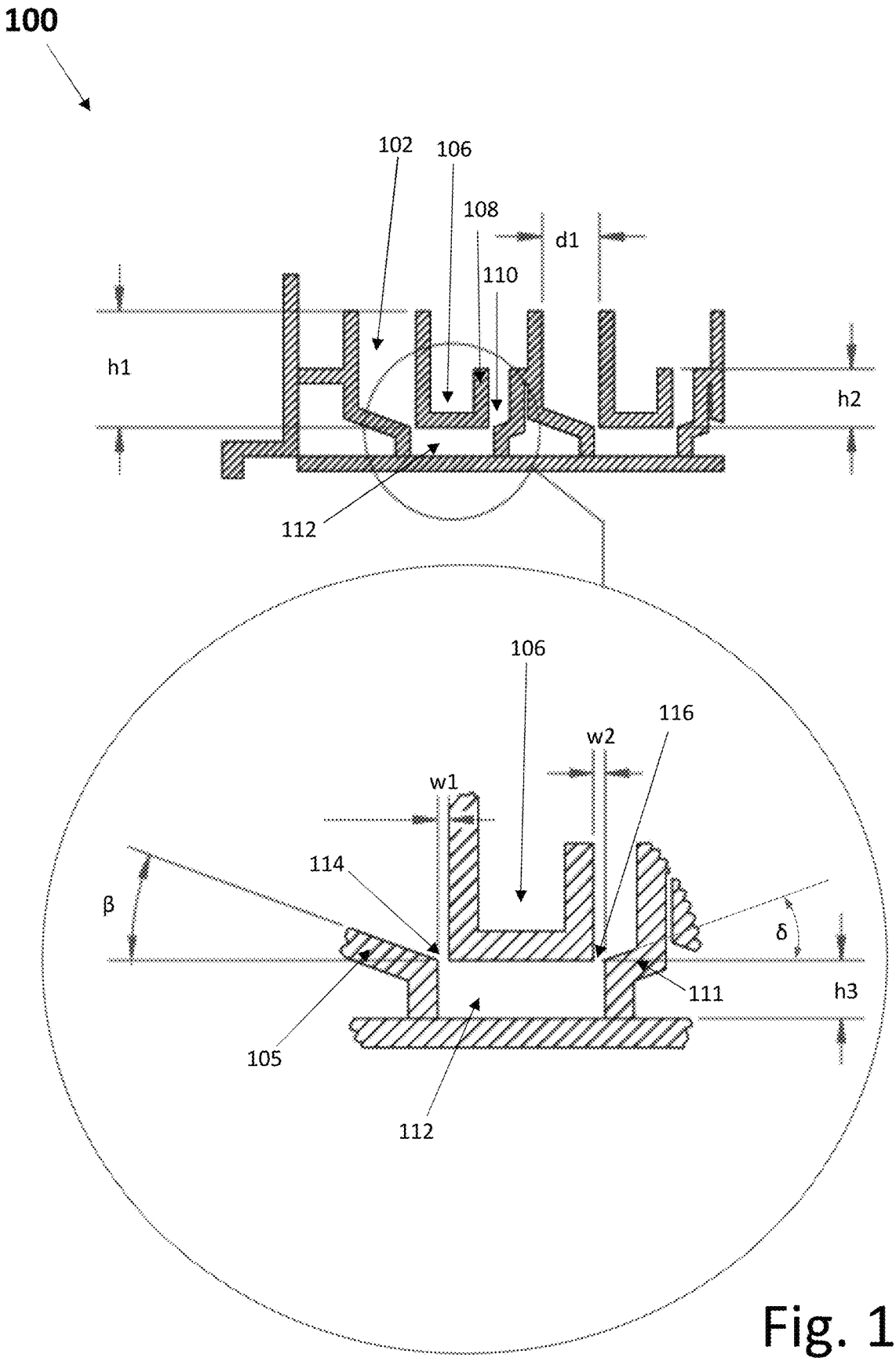
FIG. 14 is a cross-sectional side view of a detail of the multi-well plate of FIG. 11, according to some embodiments of the present invention.

FIG. 14 shows an example of different dimensions of the multi-well plate 100. The maximal height of the walls 104 of the inlet wells 102 above the lowermost point of the bottom end 105 is a height h1 and the horizontal dimension (diameter, average of the minor and major axes, width) of the inlet wells is dl. The maximal height the second wall 108 separating the observation window 106 from the outlet well 110 above the lowermost point of the bottom end 11 is h2. The height of the detection well 112 is h3. The width of the inlet channel 114 is w1, while the width of the outlet channel 116 is w2.

In a non-limiting example, h1 may be between 4 mm and 12 mm, dl may be between 2 mm and 6 mm, h2 may be between 0.5 mm to 12 mm, h3 may be between 1 and 3 mm. w1 and w2 may be between 0.1 mm and 0.7 mm. In some embodiments of the present invention these dimensions are constant within 10% along the whole multi-well plate.

It should be noted that the scope of the present invention extends to the different combination of different features presented separately. For example, the multi-well plate of FIGS. 1-9, in which the inlet wells, outlet wells, and observation windows are above planar sheet and the detection wells are under the planar sheet may have detection wells that are wider than shown in FIGS. 1-9, and more similar to the configuration of FIGS. 11-14 and may partially extend under the respective under the respective inlet and outlet wells. In another example, the bottom end of the inlet wells and/or the outlet wells of the multi-well plate of FIGS. 1-9 may be tilted as shown in the examples of FIGS. 11-14.

In any embodiments of the multi-well plate described throughout this document, the number of inlet wells may be equal to the number of outlet wells, to the number of observation windows, and to the number of detection wells. In a non-limiting example, a detection set is formed by one inlet well, one corresponding outlet well, one corresponding observation window, one corresponding detection well, a group of one or more inlet channels connecting the inlet well to the detection well, and a group of one or more outlet channels connected the outlet well to the detection well. In some embodiments of the present invention, the multi-well plate may include any number of detections sets. In a non-limiting example, the multi-well plate includes 96 detection sets disposed in a 12×8 matrix configuration. The scope of the present invention is not limited by the number of detection sets, and extends to any number of detection sets disposed in any desired configuration.

The multi-well plate of the present invention, in any of the embodiments described above, can be manufactured by using various methods, such as injection molding, 3D printing, and CNC machining, and various materials, such as PS (polystyrene), PDMS (polydimethylsiloxane), PP (polypropylene), PMMA (poly (methyl methacrylate)), PC (polycarbonate), COC (cyclic olefin copolymer), COP (Cyclic olefin polymer), and glass. For example, if the multi-well plate can be assembled with two layers as shown in FIGS. 3-9, the two layers (the first of which includes the sheet 300, the inlet wells, the walled observation windows, and the outlet wells, and the second of which includes the bottom sheet 302 with the detection wells inset therein) may be made by injection molding and then sealed by thermo bonding, mechanical bonding, chemical bonding, or plasma bonding to make sure there is no liquid leakage during liquid handling. Moreover, the multi-well plate of the present can also be fabricated without need for assembly, for example by 3D printing which is a technique which allows for the one-step creation of very complex geometry.

Reference is now made to FIG. 20-24, which show different views of a multi-well plate 400 in which a single outlet well 504 is connected to a plurality of respective detection wells (604), according to some embodiments of the present invention.

The multi-well plate 400 includes an upper sheet 402 and a lower sheet 404. The upper sheet includes a plurality of inlet wells 502 and plurality of outlet wells 504. The inlet wells are perforations traversing the upper sheet 402, surrounded by walls perpendicularly from the upper sheet. The outlet wells 504 are perforations of the upper sheet 402. The inlet wells 502 are disposed in two opposing rows. Two inlet wells 502 located in different rows opposite to each other are associated with a single outlet well 504 located between the two inlet wells 502.

The lower sheet 404 includes the following elements inset on the lower sheet: a plurality of inlet floors 602, a plurality of outlet floors 610, a plurality detection wells 604, a plurality of inlet channels 606 and a plurality of outlet channels 608.

Each inlet floor 602 is aligned with a respective inlet well 502. Each outlet floor 610 is aligned with a respective outlet well 504. At least one detection well 604 is located between an inlet floor 602 and the corresponding outlet floor 610. An inlet channel 606 leads from an inlet floor 602 to the corresponding detection well 604. An outlet channel 606 leads from a detection well 604 to the respective outlet floor. In some embodiments of the present invention, each inlet floor 602 is connected to two or more detection wells 604 via respective inlet channels 606. Because each outlet floor 610 is associated with two inlet floors, each outlet floor is connected to double the number of detection wells 604 associated with a single inlet floor 602. The connection between the detection wells 604 and their respective outlet floors 610 occurs via respective outlet channel 608.

The upper sheet 402 and the lower sheet 404 are joined together hermetically, so that liquid introduced into each inlet well 502 only reaches the respective inlet floor 602 and does not leak elsewhere. The hermetic connection also ensures that liquid does not leak out of the inlet channels 606, the outlet channels 608, the detection wells 604, and the outlet floor 610.

In use liquid is introduced into the inlet wells 502 and reaches the respective inlet floors 602. The size of the inlet channels 606 is small enough to prevent flow of the liquid from the inlet floor into the inlet channels without the application of an external force (other than gravity) to the liquid, due to the liquid's surface density.

A force is applied to the liquid contained in the inlet well 502 and inlet floor 602. The force may be due to a positive pressure from a pipette inserted into the inlet well or may be due to negative pressure (suction) through the outlet well 504. As the force is applied, the liquid from an inlet floor 602 flows to the one or more respective inlet channel connected to the inlet floor toward the respective detection wells 604. As the detection wells 604 are filled via respective inlet channels 606, air from the detection wells 604 exits from the respective outlet channels 608. In this manner the detection wells 604 can be filled without the formation of bubbles therein. As the force is still applied, the liquid flows from the detection wells 604 to at least partially fill the outlet channels 608. In this manner the liquid in the inlet channels 606 and the outlet channels 608 provides a barrier against exposure of the liquid in the detection wells to air and to the external environment. In this manner, the evaporation of the liquid inside the detection wells is substantially decreased, and the liquid may be stored in the detection wells for longer time period, allowing the observation of chemical and/or biological reactions over time, without compromising the quality of the images taken.

In some embodiments of the present invention, the upper sheet and the lower sheet are transparent to visible light in order to enable unobstructed viewing of the liquid in the detection wells 604. In some embodiments of the present invention the sidewalls 604*a* of the detection wells 604 are opaque to visible light, in order to decrease or prevent crosstalk between detection wells, as explained above.

The upper sheet may be parallel to the floors of the detection wells. This provides a fixed optical path difference in the detection wells for accurate and repeatable liquid detection.

The inlet wells may be shaped as regular or irregular cylinders, prisms, or frusto-cones. The detection wells may be shaped as regular or irregular cylinders or prisms.

The materials and manufacturing techniques for fabricating the multi-well plate 400 are the same as the materials and manufacturing techniques for fabricating the multi-well plate 100 described above.

Figure 24:
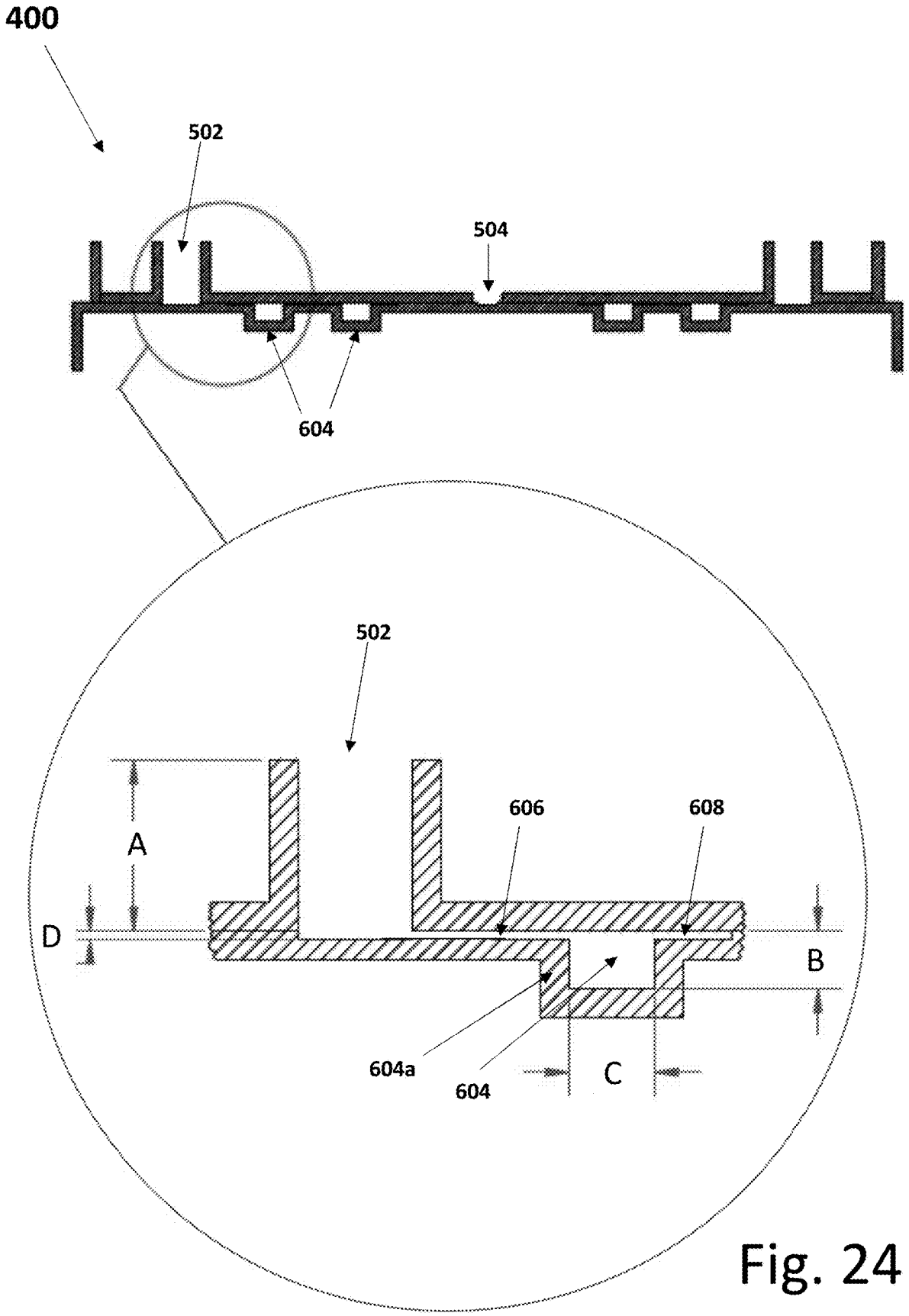
FIG. 24 is a cross-sectional side view of the multi-well plate of FIG. 20 in assembled form, according to some embodiments of the present invention.

FIG. 24 illustrates examples of dimensions of the multi-well plate 400. The height of the inlet well 502 from the bottom of the upper sheet is A. The height of the detection well 604 from the bottom of the upper sheet is B. The horizontal dimension (width, depth, diameter, average of major and minor axis, for example) of the detection well 604 is C. The thickness of the inlet channel 606 and the outlet channel 608 is D.

In some embodiments of the present invention, A is between 3 mm and 9 mm, B is between 1 mm and 3 mm, C is between 1.5 mm and 4.5 mm, while D is between 0.1 mm and 0.5 mm. These dimensions may be constant within 10% throughout the whole multi-well plate 400.

Experimental Tests

The inventors conducted several tests of prototypes of multi-well plates of the present invention. The results of these tests are presented herein for illustrative purposes only, and should not be construed as limiting the invention in any way.

Experimental Test 1

Experimental Test 1 was conducted to determine if handling of a liquid could be achieved in one independent double-well. Photographs of the steps can be seen in FIG. 25. The following are the main steps:

Three pieces of PDMS, containing an inlet well, a vertical inlet channel, a vertical outlet channel, and a detection well, were assembled to form a double-well prototype.

After assembly, the double-well prototype was placed into a well of 24-well plate.

A volume of 20 μL of liquid was added into the inlet well by pipette.

The 24-well plate containing the double-well prototype was put into a centrifuge.

Figure 25:
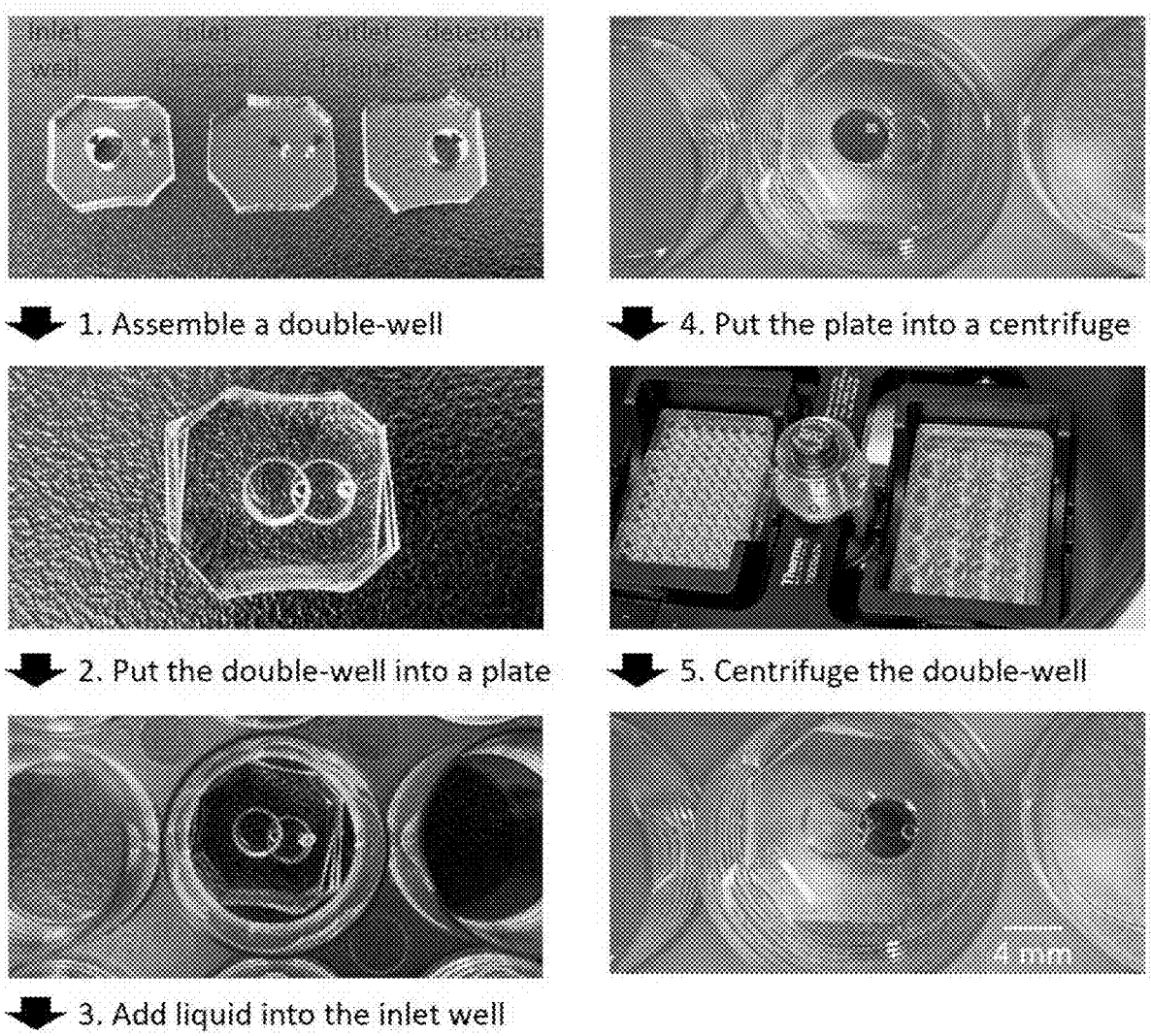
FIGS. 25-27 are photographs documenting results of second, third, and fourth experiments conducted by the inventors to assess the properties of different multi-well plates of the present invention.

The liquid within the inlet well was successfully transferred into the detection well (having capacity of 15 μL) under rotation of 1,000 rpm for 1 minute. No air bubbles were observed within the detection well, as seen in FIG. 25.

Experimental Test 2

The Experimental Test 2 was conducted to determine whether liquid handling could be achieved in one multi-well plate having 96 inlet wells shown in FIGS. 1-14. Photographs of the steps can be seen in FIG. 15. The following were the main steps:

A 96-well plate prototype according to some embodiments of the present invention was fabricated by 3D printing process.

A volume of 20 μL of liquid is added into each inlet well by multiple-channel pipette.

The 96-well plate prototype was placed into a centrifuge.

The liquid within each inlet well was successfully transferred into each detection well (20 μL volume) at a rotation of 1,000 rpm for 1 minute. No air bubbles were observed within the detection wells, as seen in FIG. 15.

Experimental Test 3

Figure 26:
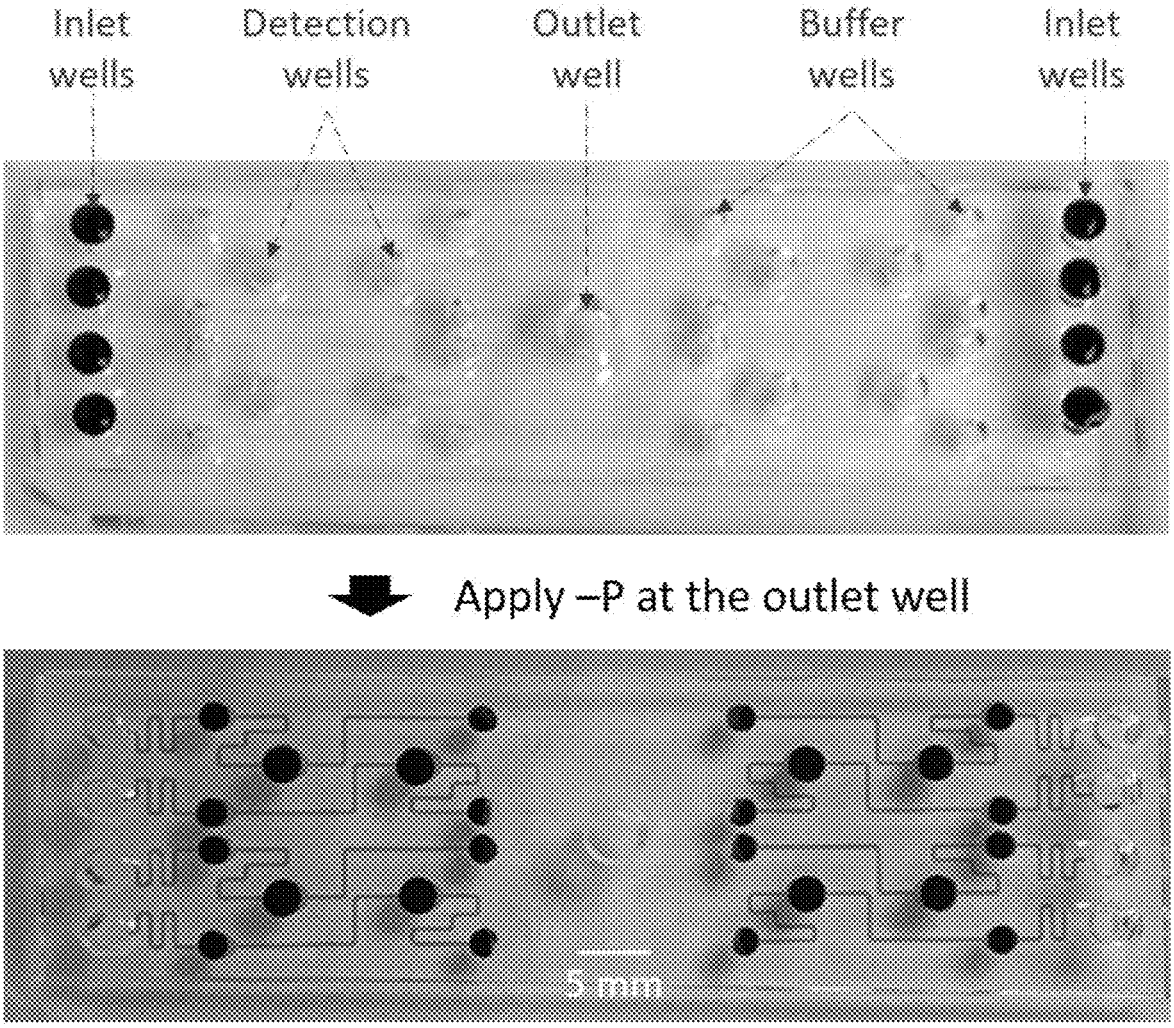

The Experimental Test 3 was conducted to determine if liquid handling could be achieved in one integrated double-well 400 according to FIGS. 20-24. The following were the main steps:

One integrated double-well prototype was made by PDMS and had 8 inlet wells, 8 detection wells, 1 outlet well, and 16 buffer wells, as seen in FIG. 26. The buffer wells are used to store excessive liquids.

A volume of 20 μL of a liquid was added into each inlet well by pipette.

A negative pressure (−160 μL volume) was applied at the shared outlet well.

The liquid within each inlet well was successfully transferred into each detection well (7 μL volume), as shown in FIG. 26. No air bubbles were observed within the detection wells.

Experimental Test 4

Experimental Test 4 was conducted to determine if liquid evaporation could be prevented in one integrated double-well 400 according to FIGS. 20-24. The following are the main steps:

The liquids are firstly transferred and stored into the detection wells (7 μL volume in each) and associated channels and buffer wells, as explained above in Experimental Test 4.

The integrated double-well was put into an incubator at 37° C. for 1 hour.

Figure 27:
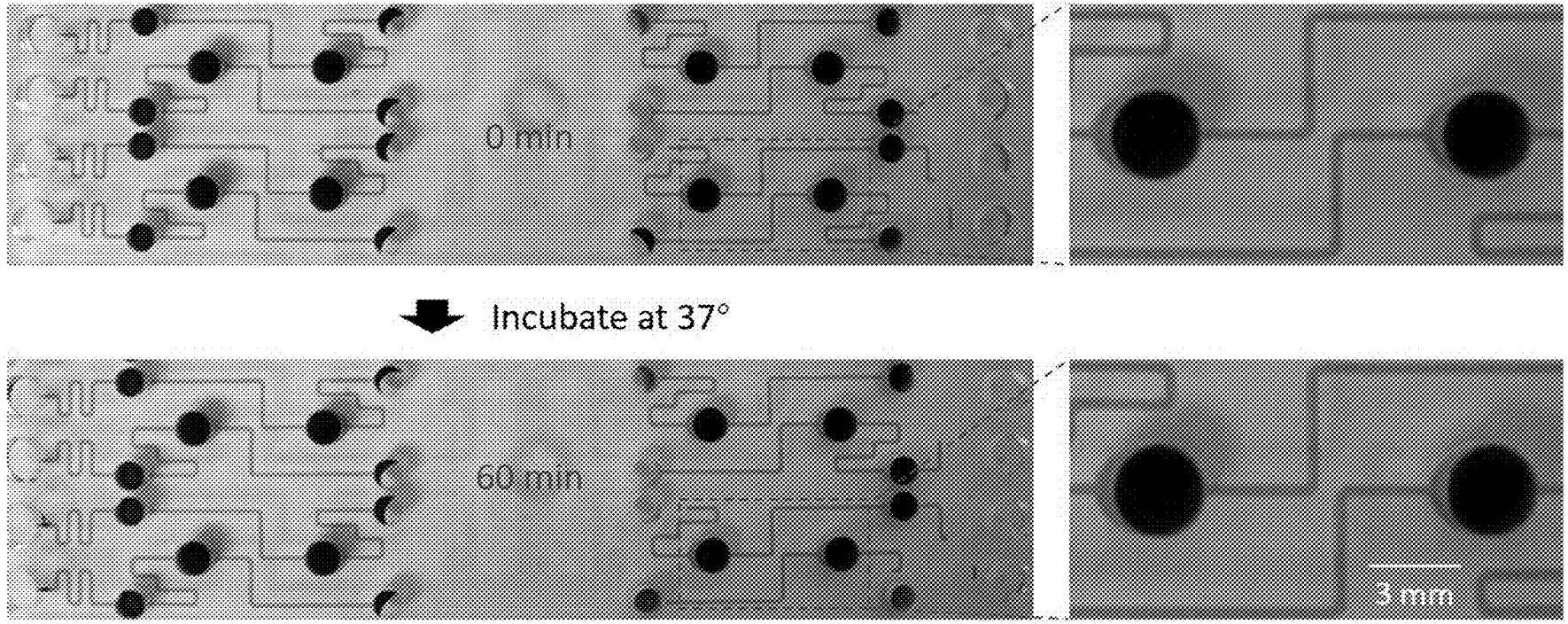

Results showed that there is no obvious difference in the liquid distribution before and after incubation, as shown in FIG. 27. Therefore, the liquids could be safely stored within the detection wells.

What is claimed is:

1. A multi-well plate comprising:

(a) a plurality of inlet wells having upper apertures and configured to receive a liquid via the upper apertures and to contain the liquid;

(b) a plurality of walled observation windows located between the inlet wells, each observation window being associated with a respective inlet well;

(c) a plurality of detection wells, each detection well being disposed below a respective observation window, being covered by the respective observation window, and being associated with the respective inlet well associated with the respective observation window;

(d) a plurality of outlet wells located between the inlet wells and the observation windows, each outlet well being associated with a respective inlet well and a respective detection well;

(e) a plurality of inlet channels, disposed in first groups of one or more inlet channels, each first group providing fluid communication between an inlet well and a respective detection well;

(f) a plurality of outlet channels, disposed in second groups of one or more outlet channels, each second group providing fluid communication between a detection well and a respective outlet well;

wherein the inlet channels are configured to prevent passage of the liquid from the inlet wells to the respective detection wells if a force smaller than a threshold force is applied to the liquid in each inlet well in a direction of each respective inlet channel.

2. The multi-well plate of claim 1, comprising a horizontal sheet, wherein:

the inlet wells are disposed on the planar base and have first walls extending upward from the sheet;

the detection wells are disposed below the sheet;

the observation windows are surrounded by second walls extending upward from the sheet;

the outlet wells are outside the first walls and the second walls;

the inlet channels and the outlet channels traverse the sheet.

3. The multi-well plate of claim 2, wherein:

at least one of the inlet channels comprises a first section that traverses the sheet and a second section extending under the sheet from the first section to a respective detection well.

4. The multi-well plate of claim 2, wherein:

at least one of the outlet channels comprises a first section that traverses the sheet and a second section extending under the sheet from the first section to a respective detection well.

5. The multi-well plate of claim 2, comprising an upper sheet and a lower sheet, wherein:

the upper sheet comprises the horizontal sheet;

the detection wells are inset on the lower sheet;

the upper sheet is placed on a top surface of the lower sheet.

6. The multi-well plate of claim 1, wherein:

the detection wells have first and second portions that are wider than the respective walled observation windows, the first portions extending under the respective inlet wells and the second portions extending under the respective outlet well;

each inlet channel is a first gap at a bottom base of a respective inlet well, configured to connect the respective inlet well to the first portion of the respective detection well;

each outlet channel is a second gap at a bottom base of a respective outlet well, configured to connect the respective outlet well to the second portion of the respective detection well.

7. The multi-well plate of claim 6, wherein the bottom base of at least one of the inlet wells is tilted downward toward the first portion of the respective detection well.

8. The multi-well plate of claim 6, wherein the bottom base of at least one of the outlet wells is tilted downward toward the first portion of the respective detection well.

9. The multi-well plate of claim 1, wherein at least one of the observation windows is planar and parallel to a base of the of the respective detection well.

10. The multi-well plate of claim 1, wherein at least one of the observation windows is transparent to visible light.

11. The multi-well plate of claim 10, wherein a base of at least one the detection wells is transparent to visible light.

12. The multi-well plate of claim 11, wherein a wall of at least one the detection wells is opaque to visible light.

13. The multi-well plate of claim 11, wherein a wall of at least one the detection wells is transparent to visible light.

14. The multi-well plate of claim 1, comprising a plurality of separation walls configured to separate the plurality of outlet channels from each other.

15. The multi-well plate of claim 1, wherein the inner channels have horizontal dimensions in the range between 0.1 and 0.9 mm.

* * * * *